US007356286B2

(12) United States Patent
Itabashi et al.

(10) Patent No.: US 7,356,286 B2
(45) Date of Patent: Apr. 8, 2008

(54) CHARGER, IMAGE FORMING APPARATUS AND PROCESS CARTRIDGE

(75) Inventors: Nao Itabashi, Nagoya (JP); Takahiro Nishimoto, Nagoya (JP); Kunihiko Kondo, Nagoya (JP); Fumikazu Sato, Kounan (JP); Ikunobu Yoshiyama, Anjou (JP); Tsutomu Suzuki, Nagoya (JP)

(73) Assignee: Brother Kogyo Kabushiki Kaisha, Nagoya-Shi, Aichi-ken (JP)

( * ) Notice: Subject to any disclaimer, the term of this patent is extended or adjusted under 35 U.S.C. 154(b) by 136 days.

(21) Appl. No.: 11/200,106

(22) Filed: Aug. 10, 2005

(65) Prior Publication Data

US 2006/0034635 A1 Feb. 16, 2006

(30) Foreign Application Priority Data

Aug. 10, 2004 (JP) ..... P2004-233456
Sep. 29, 2004 (JP) ..... P2004-284848

(51) Int. Cl.
*G03G 15/02* (2006.01)

(52) U.S. Cl. ..... 399/170; 399/171; 399/172; 399/173

(58) Field of Classification Search ..... 399/92, 399/93, 94, 95, 170, 171, 172, 173
See application file for complete search history.

(56) References Cited

U.S. PATENT DOCUMENTS

| | | | | |
|---|---|---|---|---|
| 5,781,829 | A * | 7/1998 | Wong et al. | 399/91 |
| 7,174,114 | B2 * | 2/2007 | Gila et al. | 399/100 |
| 2003/0039485 | A1 | 2/2003 | Yoshiyama | |
| 2003/0185584 | A1 * | 10/2003 | Hirose et al. | 399/92 |

FOREIGN PATENT DOCUMENTS

| | | |
|---|---|---|
| JP | 10-133550 | 5/1998 |
| JP | 2003-084632 | 3/2003 |
| JP | 2003-140438 | 5/2003 |
| JP | 2003-287993 | 10/2003 |

* cited by examiner

*Primary Examiner*—Hoang Ngo
(74) *Attorney, Agent, or Firm*—Banner & Witcoff, Ltd

(57) ABSTRACT

A charger is opposed to a charging subject member and charges the charging subject member by generating corona discharge. The charger includes: a discharge electrode; and a pair of facing electrodes that are disposed to face with each other being the discharge electrode interposed therebetween and arranged to be distant from the discharge electrode, wherein the facing electrodes are arranged that an interval between the facing electrodes gradually decreases towards the charging subject member.

37 Claims, 25 Drawing Sheets

CHARGER, IMAGE FORMING APPARATUS AND PROCESS CARTRIDGE

BACKGROUND OF THE INVENTION

1. Field of the Invention

The present invention relates to a charger, an image forming apparatus, and a process cartridge.

2. Description of the Related Art

Conventional image forming apparatus such as laser printers employ a technique of charging a photoreceptor by causing corona discharge using a charger. For example, JP-A-2003-287993 discloses a technique that a shutter, a duct, and an exhaust room surrounded by a partition member are formed above a scorotron charger and ozone is removed by sucking air so that an air flow occurs in a direction from a photoreceptor to the charger.

Scorotron chargers having a discharge wire and a grind are known as chargers used for laser printers. For example, a scorotron charger disclosed in US2003/03485A1 (JP-A-2003-140438) is equipped with right and left side plates and a grid portion that is opposed to a discharge electrode. The grid portion is provided with grid wires and a surface plate that is opposed to a photoreceptor drum. On the other hand, the right and left side plates serving as facing electrodes are bent from the surface plate of the grid portion so as to make an approximately right angle.

SUMMARY OF THE INVENTION

The conventional technique as disclosed in JP-A-2003-287993 has a problem that ions generated by corona discharge do not tend to flow to the photoreceptor side and efficient charging cannot be attained easily because an air flow is generated in the direction from the photoreceptor to the charger. On the other hand, if an air flow is generated in the opposite direction, that is, in the direction from the charger to the photoreceptor, polluted air is supplied from around a fixing member to the charger and a charging wire is thereby polluted.

Such pollution of the charging wire is caused by sticking of pollutants such as silica. More specifically, the air around the fixing member contains large amounts of pollutants such as silica that are scattered from around the fixing member. When air containing those pollutants flows from the fixing member side to the charger side, they stick to and pollute the charging wire. When the charging wire is polluted in this manner, the thickness of the wire becomes non-uniform. Unevenness becomes prone to occur in discharge, which influences the image quality.

Incidentally, at present, attempts to miniaturize image forming apparatus are being made. One effective method for miniaturizing an image forming apparatus is to decrease the diameter of a photoreceptor drum and accordingly arrange, more densely, such members as a charger, a developing unit, a transfer unit, a cleaning unit, and a charge removing unit that should be arranged around the photoreceptor drum.

However, the decrease of the diameter of the photoreceptor drum results in shortening of its circumference. Therefore, where the charger and the other members are arranged around the photoreceptor in its circumferential direction, the charger is prone to interfere with the other members. A charger is desired having such a structure as not to be prone to interfere with the other members and to be able to relax space-related restrictions effectively even in the case where they are arranged around the photoreceptor.

On the other hand, chargers are configured so as to supply the photoreceptor with ions generated by corona discharge. In an inefficient structure in which generated ions are not very apt to be supplied to the photoreceptor, the amount of discharge needs to be increased to secure a proper amount of ions supplied to the photoreceptor, which increases the apparatus-side Load. In these circumstances, a charger is desired having such a structure that generated ions are apt to be supplied to the photoreceptor and discharge can be caused efficiently.

The present invention provides a configuration that allows the photoreceptor to be charged efficiently and in which polluted air is not prone to be supplied from around the fixing member to the charger and hence discharge failures can be suppressed effectively.

The present invention provides a charger having such a structure as to be able to easily accommodate miniaturization of a photoreceptor and to be able to efficiently supply the photoreceptor with ions generated by discharge.

According to a first aspect of the invention, there is provided a charger that is opposed to a charging subject member and charges the charging subject member by generating corona discharge, the charger including: a discharge electrode; and a pair of facing electrodes that are disposed to face with each other being the discharge electrode interposed therebetween and arranged to be distant from the discharge electrode, wherein the facing electrodes are arranged that an interval between the facing electrodes gradually decreases towards the charging subject member.

According to a second aspect of the invention, there is provided an image forming apparatus including: a photoreceptor; a charger that is opposed to the photoreceptor and charges the photoreceptor by generating corona discharge; and a fixing member that fixes, on a recording subject medium, a developer image that is formed on the photoreceptor and transferred to the recording subject medium, wherein the charger includes: a discharge electrode; and a pair of facing electrodes that are disposed to face with each other being the discharge electrode interposed therebetween and arranged to be distant from the discharge electrode, wherein the facing electrodes are arranged that an interval between the facing electrodes gradually decreases towards the charging subject member.

According to a third aspect of the invention, there is provided an image forming apparatus including: a photoreceptor; a charger that is opposed to the photoreceptor and charges the photoreceptor by generating corona discharge with a wire; and a fixing member that fixes, on a recording subject medium, a developer image that is formed on the photoreceptor and transferred to the recording subject medium; an inflow suppressing member disposed between the charger and the fixing member and separates a charger-side space and a fixing member-side space from each other, the inflow suppressing member suppressing inflow of air into the charger-side space from the fixing member-side space; and an air flow generating unit that generates an air flow that is directed from the charger-side space towards the photoreceptor.

According to a fourth aspect of the invention, there is provided a process cartridge that is configured to be detachable from an apparatus main body of an image forming apparatus having a fixing member that fixes a developer image transferred to a recording subject medium, the process cartridge including: a photoreceptor on which the developer image is formed; a charger that is opposed to the photoreceptor and charges the photoreceptor by generating corona discharge; and an inflow suppressing member disposed between the charger and the fixing member and separates a charger-side space and a fixing member-side space from each other, the inflow suppressing member suppressing inflow of air into the charger-side space from the fixing member-side space, wherein an air flow that is directed from the charger-side space towards the photoreceptor is generated.

DETAILED DESCRIPTION OF THE EMBODIMENTS

Embodiments of the invention will be described below with reference to the drawings.

First Embodiment

1. Total Configuration

Figure 1:
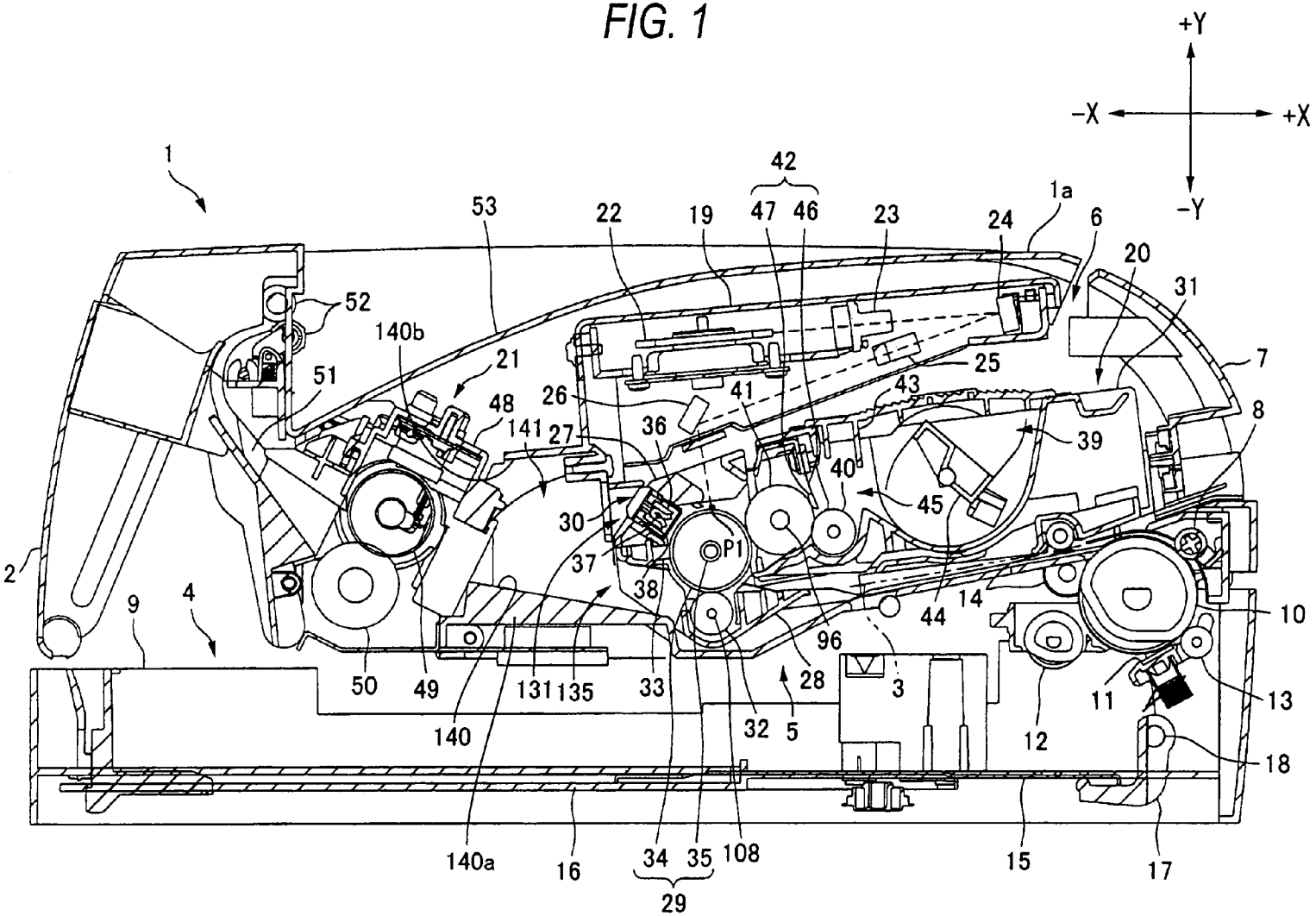
FIG. 1 is a side sectional view of a substantial part of a laser printer as an image forming apparatus according to a first embodiment in a state that a front cover is closed.
Figure 2:
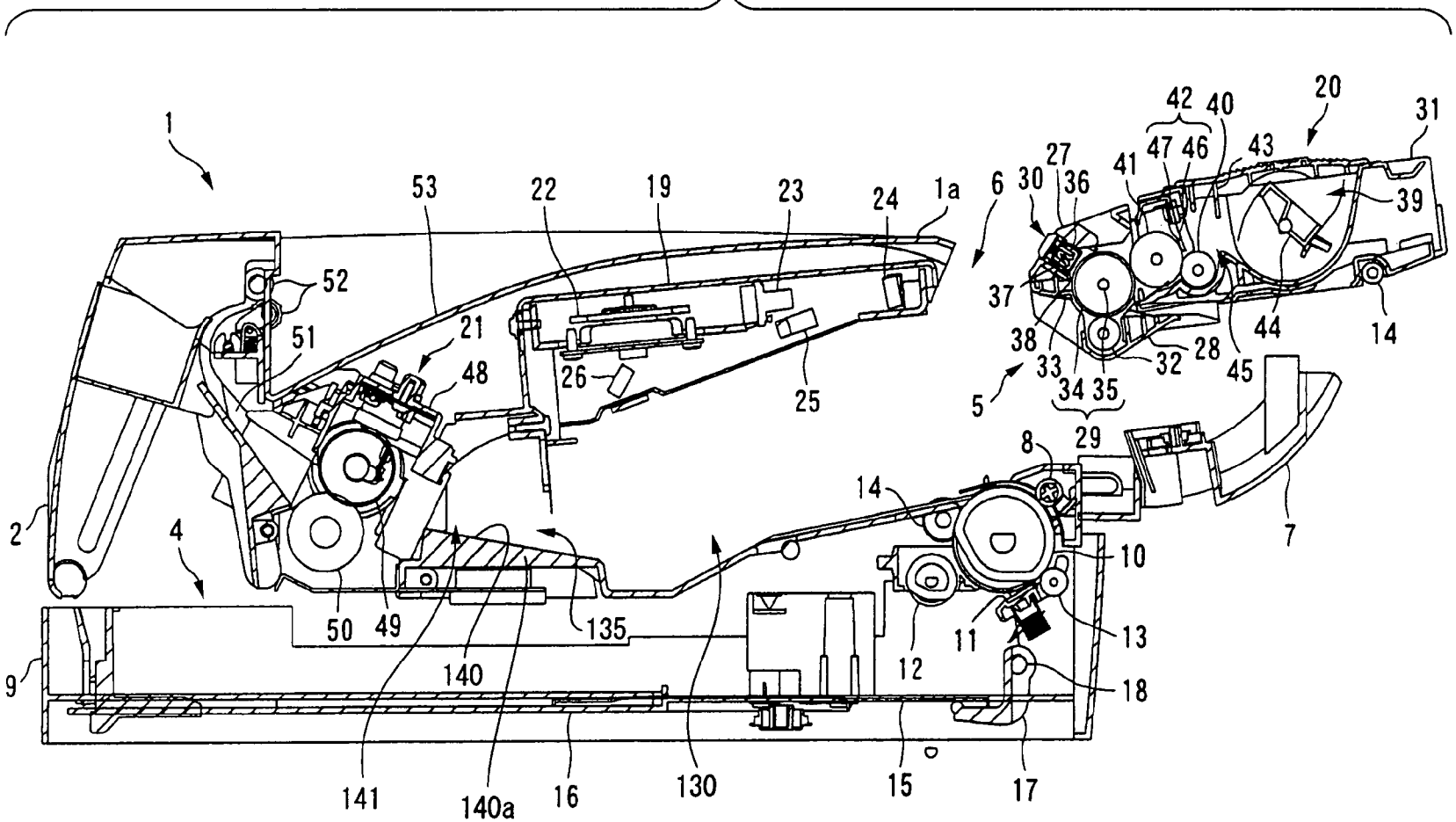
FIG. 2 is a side sectional view of the substantial part of the laser printer of FIG. 1 in a state that the front cover is opened.

FIGS. 1 and 2 are side sectional views of a substantial part of a laser printer as an image forming apparatus according to the embodiment of the invention. The laser printer 1 is equipped with a main body casing 2, a feeder unit 4 for supplying a sheet 3 as a recording subject medium, an image forming unit 5 for forming an image on the sheet 3 supplied, and other units and components. The feeder unit 4 and the image forming unit 5 are housed in the main body casing 2.

A front wall of the main body casing 2 is formed with an attachment/detachment opening 6 for attachment and detachment of a process cartridge 20 (described later) as well as a front cover 7 for opening and closing the attachment/detachment opening 6. The front cover 7 is rotatably supported by a cover shaft (not shown) that is inserted in a bottom end portion of the front cover 7. With this structure, if the front cover 7 is closed by rotating it about the cover shaft, the attachment/detachment opening 6 is closed by the front cover 7 as shown in FIG. 1. If the front cover 7 is opened (inclined) with the cover shaft serving as a supporting point, the attachment/detachment opening 6 is opened as shown in FIG. 2, whereby the process cartridge 20 can be attached to or detached from the main body casing 2 through the attachment/detachment opening 6. In the laser printer 1, a main body part other than the process cartridge 20 is an apparatus main body 1*a*.

In the following description, the side where the front over 7 is provided will be called "front side" and the side opposite to it will be called "rear side" (see FIG. 1).

The feeder unit 4 is equipped with a sheet supply tray 9 that is attached to a bottom portion of the main body casing 2 detachably, a sheet feed roller 10 and a separation pad 11 that are disposed above a front end portion of the sheet supply tray 9, a pickup roller 12 that is disposed behind the sheet feed roller 10, a pinch roller 13 that is disposed at a bottom-front position with respect to the sheet feed roller 10 so as to be opposed to it, a paper powder removal roller 8 that is disposed at a top-front position with respect to the sheet feed roller 10 so as to be opposed to it, and registration rollers 14 that are disposed at a top-rear position with respect to the sheet feed roller 10.

A sheet pressing plate 15 on which sheets 3 can be stacked is provided inside the sheet supply tray 9. With its rear end portion supported swingably, the sheet pressing plate 15 can be swung between a placement position where its front end portion is located below and it extends parallel with a bottom plate 16 of the sheet supply tray 9 and a transport position where its front end portion is located above and it is inclined.

A lever 17 for lifting up the front end portion of the sheet pressing plate 15 is disposed in a front end portion of the sheet supply tray 9. The lever 17 has a generally L-shaped cross section and extends from in front of the sheet pressing plate 15 to below it. A top end portion of the lever 17 is attached to a lever shaft 18 that is disposed in the front end portion of the sheet supply tray 9 and a rear end portion of the lever 17 is in contact with a front end portion of the bottom surface of the sheet pressing plate 15. With this structure, when clockwise (as viewed in the figures) rotational drive force is applied to the lever shaft 18, the lever 17 is rotated with the lever shaft 18 as a supporting point. The rear end portion of the lever 17 lifts up the front end portion of the sheet pressing plate 15, whereby the sheet pressing plate 15 is moved to the transport position.

When the sheet pressing plate 15 is moved to the transport position, the sheets 3 on the sheet pressing plate 15 are pressed against the pickup roller 12 and sheets start to be transported toward the boundary between the sheet feed roller 10 and the separation pad 11 by rotation of the pickup roller 12.

When the sheet supply tray 9 is detached from the main body casing 2, the front end portion of the sheet pressing plate 15 lowers due to its own weight and the sheet pressing plate 15 is moved to the placement position. In a state that the sheet pressing plate 15 is located at the placement position, sheets 3 can be stacked on the sheet pressing plate 15.

The sheets 3 that have been sent out toward the boundary between the sheet feed roller 10 and the separation pad 11 are held between the sheet feed roller 10 and the separation pad 11. As the sheet feed roller 10 is rotated, sheets 3 are separated into single sheets reliably and fed one by one. A sheet 3 thus fed passes between the sheet feed roller 10 and the pinch roller 13, and is transported to the registration rollers 14 after paper powder is removed from the sheet 3.

Being configured as a pair of rollers, the registration rollers 14 register the sheet 3 and then transport the sheet 3 to a transfer position between a photoreceptor 29 and a transfer roller 32 (both described later) where a toner image is to be transferred from the photoreceptor 29 to the sheet 3.

The image forming unit 5 is equipped with equipped with a scanner unit 19, the process cartridge 20, and a fixing member 21.

The scanner unit 19 occupies a top portion of the main body casing 2, and is equipped with a laser light source (not shown), a polygon mirror 22 that is driven rotationally, an fθ lens 23, a reflector 24, a lens 25, and a reflector 26. As indicated by a broken line, a laser beam emitted from the laser light source according to image data is deflected by the polygon mirror 22, passes through the fθ lens 23, is path-folded by the reflector 24, passes through the lens 25, is path-bent downward by the reflector 26, and is finally applied to the surface of a drum main body 34 of the photoreceptor 29 (described later) of the process cartridge 20.

Figure 6:
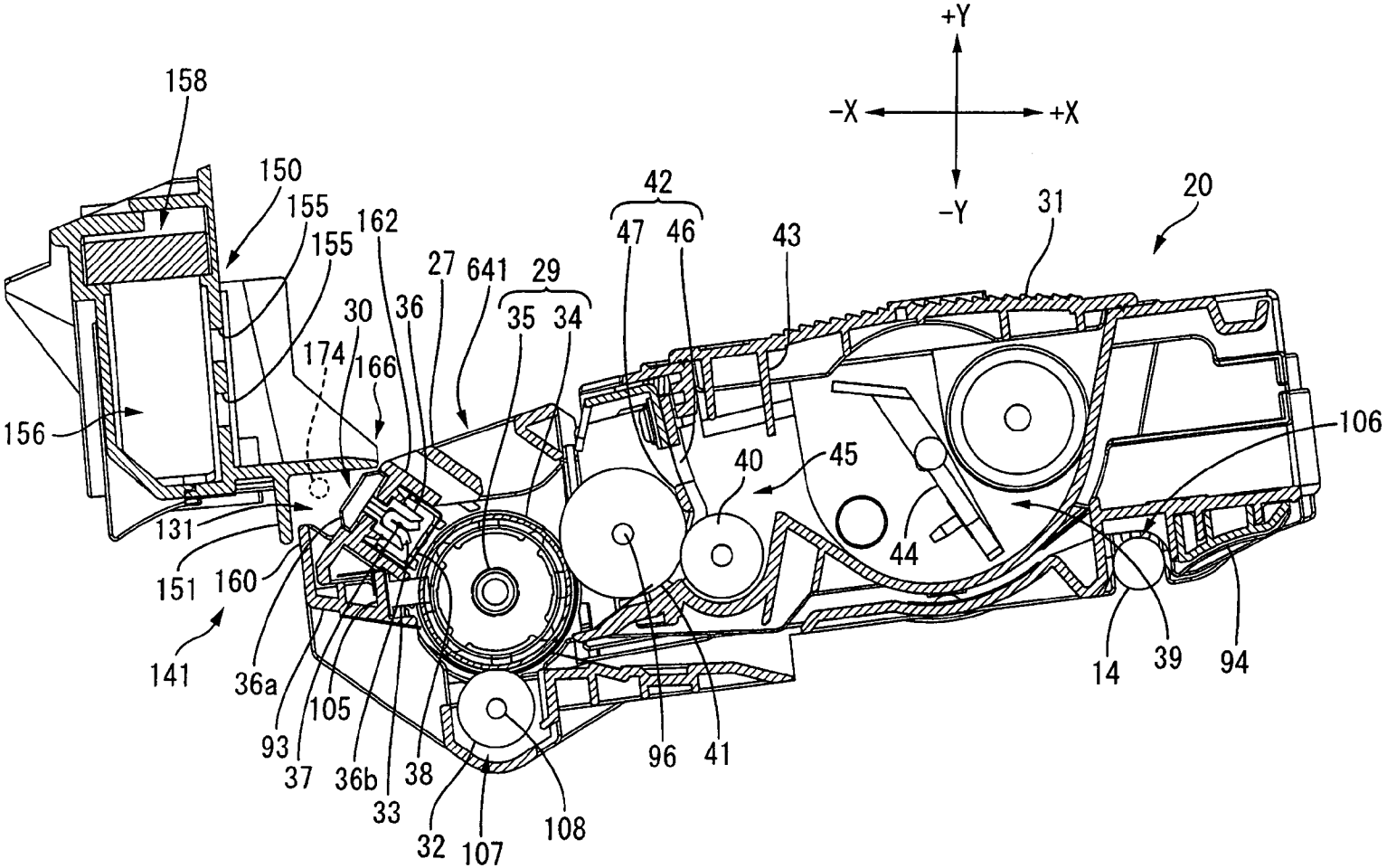
FIG. 6 is a sectional view taken along a cutting line VI-VI in FIG. 3.

The process cartridge 20 is attached to the main body casing 2 detachably so as to be disposed under the scanner unit 19. The process cartridge 20, as cases, a top frame 27 and a bottom frame 28 that is separate from and is combined with the top frame 27. As shown in FIG. 6, the process cartridge 20 is equipped with, in the cases, the photoreceptor 29, a scorotron charger 30 (hereinafter also referred to simply as "charger 30") as a charger, a development cartridge 31, the transfer roller 32, and a cleaning brush 33.

The photoreceptor drum 29 is equipped with the drum main body 34 that is cylindrical and whose outermost layer is a positively chargeable photoreceptor layer made of polycarbonate or the like and a metal drum shaft 35 that is the axis of the drum main body 34 and extends in its longitudinal direction. The drum shaft 35 is supported by the top frame 27 and the drum main body 34 is rotatably supported by the drum shaft 35. In this manner, the photoreceptor 29 is provided in the top frame 27 so as to be rotatable about the drum shaft 35.

The scorotron charger 30 is supported by the top frame 27 and is disposed at a top-rear position with respect to the photoreceptor 29 so as to be opposed to the photoreceptor 29 with a prescribed interval (contact with the photoreceptor 29 is avoided). The scorotron charger 30 is equipped with a discharge wire 37, walls that extend in the axial direction of the photoreceptor 29 and are disposed to face with each other with a prescribed interval, and a grid 38 that is disposed between the discharge wire 37 and the photoreceptor 29 and serves to control the amount of discharge from the discharge wire 37 to the photoreceptor 29. In the scorotron charger 30, a bias voltage is applied to the grid 38 and a high voltage is applied to the discharge wire 37, whereby corona discharge occurs from the discharge wire 37. As a result, the surface of the photoreceptor 29 can be charged positively in a uniform manner.

A wiper 36 (described later) for cleaning the discharge wire 37 is provided in the scorotron charger 30 so as to hold the discharge wire 37 from both sides.

The development cartridge 31 has a box shape that is open on the rear side, and is attached to the bottom frame 28 detachably. A toner accommodation room 39, a supply roller 40, a development roller 41, and a layer thickness limiting blade 42 are provided in the development cartridge 31.

The toner accommodation room 39 is a front internal space of the development cartridge 31 that is separated by a partition plate 43. A developer that is a positively chargeable, non-magnetic one-component toner is charged in the toner accommodation room 39. The toner is a polymeric toner obtained by copolymerizing, by suspension polymerization, polymerizable monomers that are, for example, a styrene monomer such as styrene and an acrylic monomer such as acrylic acid, alkyl (C1-C4) acrylate, or alkyl (C1-C4) methacrylate. Such a polymeric toner consists of generally spherical particles and is very high in flowability, and hence enables high-quality image formation.

The toner contains a colorant such as carbon black and wax, and an additive such as silica is added to increase the flowability. The average particle diameter of the toner is about 6 to 10 μm.

An agitator 44 is provided in the toner accommodation room 39. The toner in the toner accommodation room 39 is agitated by the agitator 44, and toner is discharged toward the supply roller 40 through an opening 45 that is formed under the partition plate 45 and allows passage in the front-rear direction.

The supply roller 40 is disposed behind the opening 45 and supported rotatably by the development cartridge 31. The supply roller 40 is configured in such a manner that a metal roller shaft is covered with a roller made of a conductive foamed material. The supply roller 40 is driven rotationally by motive power supplied from a motor (not shown).

The development roller 41 is disposed behind the supply roller 40, and is supported rotatably by the development cartridge 31 in such a manner that the development roller 41 and the supply roller 40 are in contact with each other and compress each other. The development roller 41 is opposed to and is in contact with the photoreceptor 29 in a state that the development cartridge 31 is attached to the bottom frame 28. The development roller 41 is configured in such a manner that a metal roller shaft 96 is covered with a roller made of a conductive rubber material. In a rear end portion of the development cartridge 31, both end portions of the roller shaft 96 project outward from the side surfaces of the development cartridge 31 in the width direction that is perpendicular to the front-rear direction (see FIGS. 3 and 4). The roller of the development roller 41 is configured in such a manner that the surface of a roller main body made of conductive urethane rubber or silicone rubber containing carbon fine particles etc. is covered with a coat layer made of urethane rubber or silicone rubber containing fluorine. During development, a development bias is applied to the development roller 41. The development roller 41 is rotationally driven in the same direction as the supply roller 40 by motive power supplied from a motor (not shown).

The layer thickness limiting blade 42 is configured in such a manner that a pressing portion 47 that is made of insulative silicone rubber and has a semicircular cross section is provided on a tip portion of a blade main body 46 made of a metal leaf spring member. The layer thickness limiting blade 42 is supported by the development cartridge 31 at a position above the development roller 41, and the pressing portion 47 is pressed against the development roller 41 by elastic force of the blade main body 46.

Toner that is discharged through the opening 45 is supplied to the development roller 41 by rotation of the supply roller 40. During that course, the toner is charged positively by friction between the supply roller 40 and the development roller 41. The toner that has been supplied onto the development roller 41 goes into the boundary between the pressing portion 47 of the layer thickness limiting blade 42 and the development roller 41 as the development roller 41 is rotated. And the toner comes to be carried by the development roller 41 as a thin layer having a constant thickness.

The transfer roller 32 is rotatably supported by the bottom frame 28. In a state that the top frame 27 and the bottom frame 28 are combined together, the transfer roller 32 is opposed to the photoreceptor 29 in the vertical direction and is in contact with the latter so that they can nip a sheet 3. The transfer roller 32 is configured in such a manner that a metal roller shaft 108 is covered with a roller made of a conductive rubber material. During a transfer, a transfer bias is applied to the transfer roller 32. The transfer roller 32 is rotationally driven in the direction opposite to the rotation direction of the photoreceptor 29 by motive power supplied from a motor (not shown).

The cleaning brush 33 is attached to the bottom frame 28, and is disposed behind the photoreceptor 29 so as to be opposed to and be in contact with the photoreceptor 29 in a state that the top frame 27 and the bottom frame 28 are combined together.

As the photoreceptor 29 is rotated, its surface is charged positively in a uniform manner by the scorotron charger 30 and is then scanned at high speed with (i.e., exposed to) a laser beam coming from the scanner unit 19, whereby an electrostatic latent image corresponding to an image to be formed on a sheet 3 is formed.

Then, as the development roller 41 is rotated, toner that is carried by the development roller 41 and charged positively is supplied to the exposed portions (where the potential has been lowered by the exposure to the laser beam) of the surface of the photoreceptor 29 that was charged positively in a uniform manner. As a result, the electrostatic latent image on the photoreceptor 29 is visualized and a toner image is formed on the surface of the photoreceptor 29 by inverted development.

Then, as shown in FIG. 1, the toner image formed on the surface of the photoreceptor 29 is transferred to a sheet 3 because of the presence of a transfer bias applied to the transfer roller 32 when the sheet 3 that has been transported by the registration rollers 14 passes the transfer position between the photoreceptor 29 and the transfer roller 32. The sheet 3 to which the toner image has been transferred is transported to the fixing member 21.

Transfer residual toner that remains on the photoreceptor 29 after the transfer is collected by the development roller 41. Paper powder that has come from the sheet 3 and is stuck to the photoreceptor 29 after the transfer is collected by the cleaning brush 33.

The fixing member 21 is disposed behind the process cartridge 20 and is equipped with a fixing member frame 48. A heating roller 49 and a pressing roller 50 are provided in the fixing member frame 48.

The heating roller 49 is equipped with a metal pipe whose surface is coated with a fluororesin and a halogen lamp for heating that is provided in the metal pipe. The heating roller 49 is rotationally driven by motive power supplied from a motor (not shown).

The pressing roller 50 is disposed below the heating roller 49, and is opposed to the heating roller 49 so as to be pressed against it. The pressing roller 50 is configured in such a manner that a metal roller shaft is covered with a roller made of a rubber material. The pressing roller 50 is rotated so as to follow the rotation of the heating roller 49.

In the fixing member 21, the toner that has been transferred to the sheet 3 at the transfer position is fixed thermally when the sheet 3 passes between the heating roller 49 and the pressing roller 50. The sheet 3 on which the toner has been fixed is transported to a sheet ejection path 51 that extends upward toward the top surface of the main body casing 2. The sheet 3 that has been transported to the sheet ejection path 51 is ejected onto a sheet ejection tray 53 that is part of the top surface of the main body casing 2 by a sheet ejection roller 52 that is disposed above the sheet ejection path 51.

Figure 3:
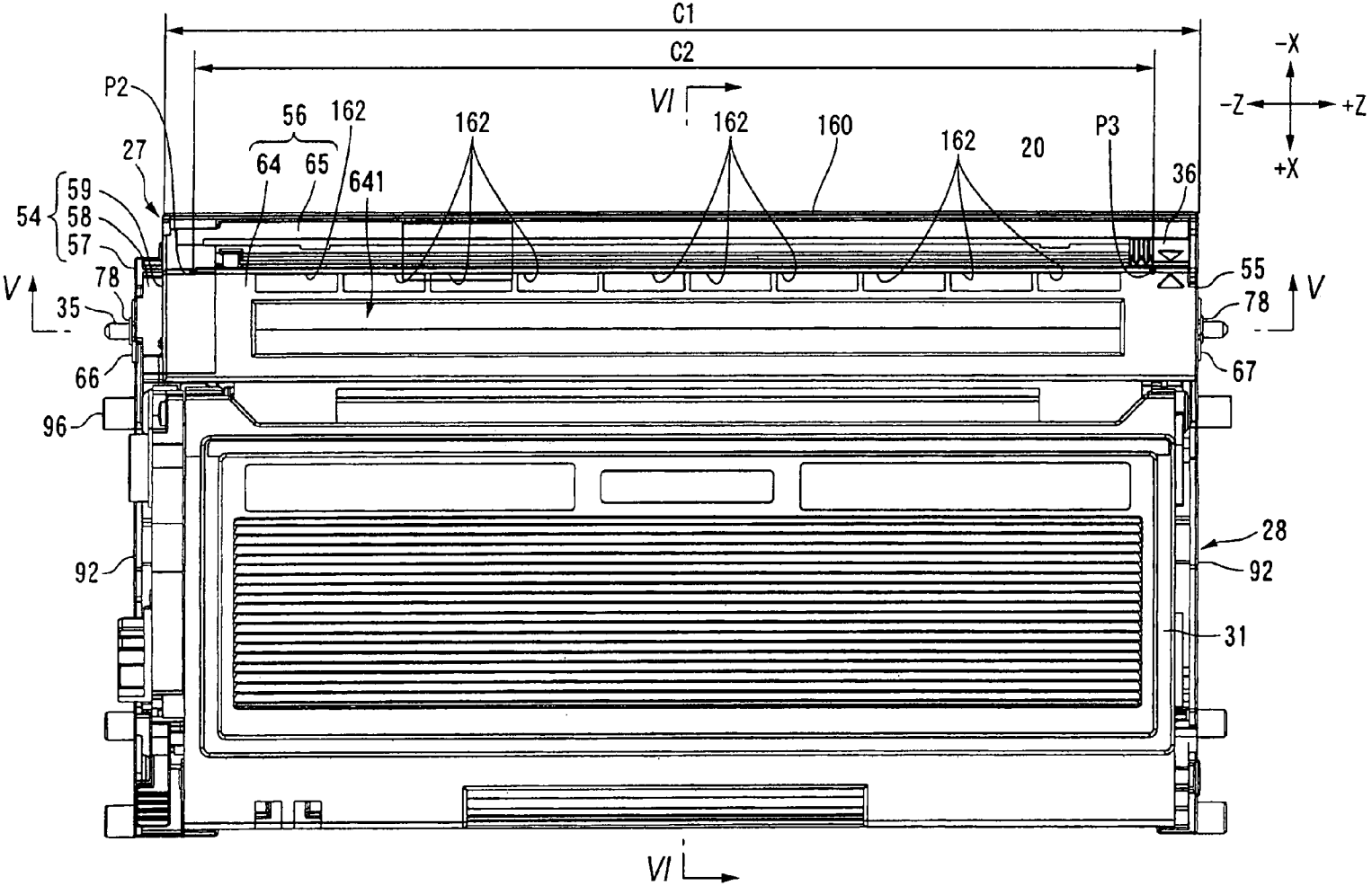
FIG. 3 is a plan view of a process cartridge shown in FIG. 1.
Figure 4:
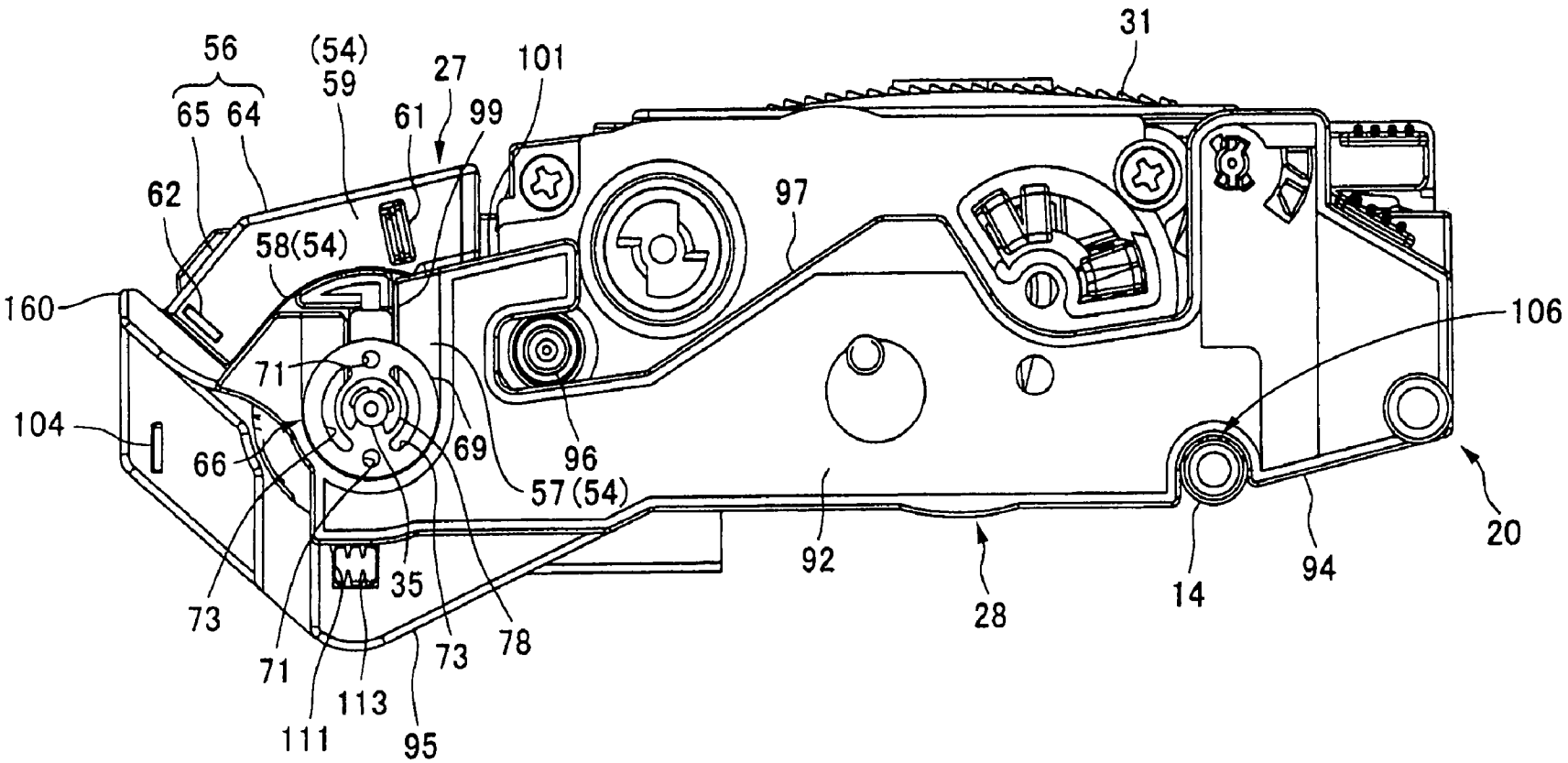
FIG. 4 is a side view of the process cartridge shown in FIG. 1.
Figure 5:
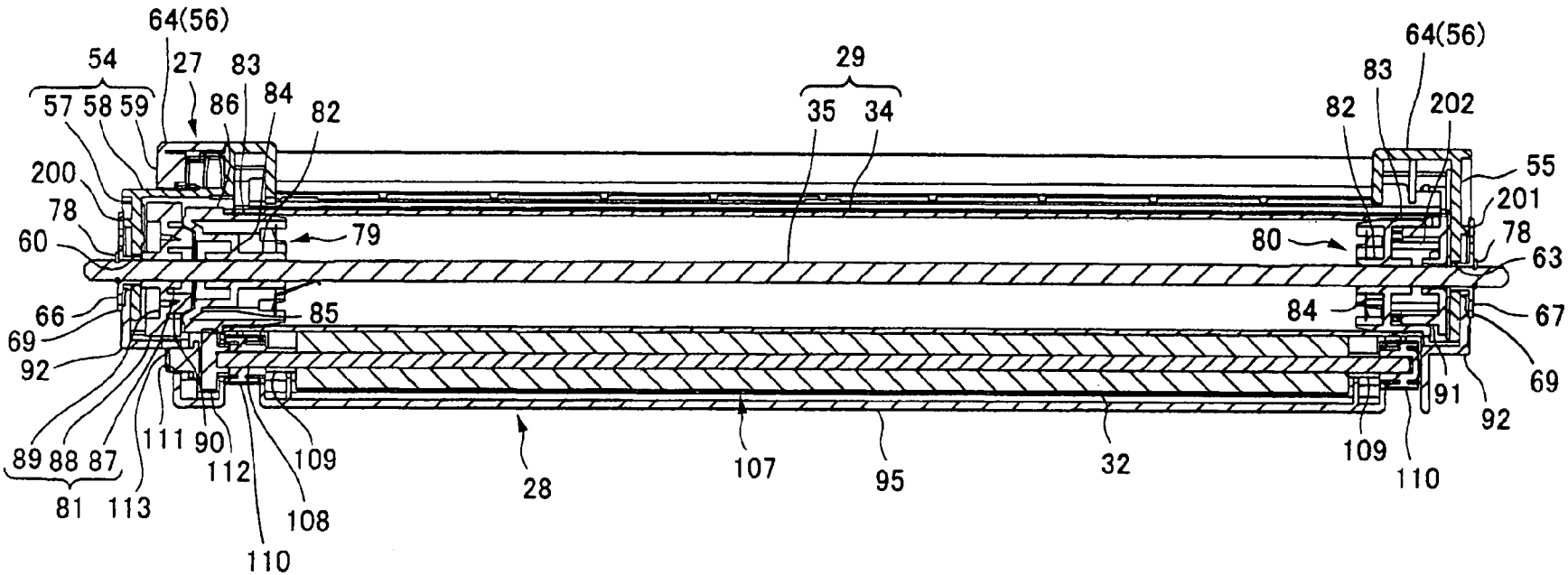
FIG. 5 is a sectional view taken along a cutting line V-V in FIG. 3.

FIG. 3 is a plan view of the process cartridge 20. FIG. 4 is a side view of the process cartridge 20. FIG. 5 is a sectional view taken along a cutting line V-V in FIG. 3. FIG. 6 is a sectional view taken along a cutting line B-B in FIG. 3 and a corresponding sectional view of a duct.

As shown in FIG. 3, the top frame 27 is provided with a left side wall 54, a right side wall 55, and a top wall 56 that are integral with each other. As shown in FIG. 6, the top frame 27 is open on the front side and at the bottom.

As shown in FIG. 5, the left side wall 54 is provided with a bottom-left side plate 57 that is disposed on one side of the drum main body 34 in the width direction that is perpendicular to the front-rear direction (this one side in the width direction will be hereinafter referred to as "left side" and the other side in the width direction as "right side"), an extended plate 58 that extends rightward from the top end of the bottom-left side plate 57 and covers a drum gear 81 (described later) from above, and a top-left side plate 59 that extends upward from the right end of the extended plate 58 (also see FIGS. 3 and 4).

The drum shaft 35 is inserted in the bottom-left side plate 57, and an insertion hole 60 for fitting with a bearing member 66 is formed through the bottom-left side plate 57. The bottom-left side plate 57 is formed with, around the insertion hole 60, a spacer portion 200 that projects leftward (outward) The spacer portion 200 supports a flange-shaped disc portion 69 of the bearing member 66 in such a manner that a slight gap is formed between the disc portion 69 and the bottom-left side plate 57 in the right-left direction.

As shown in FIG. 4, a wire electrode 61 for supplying electricity to the discharge wire 37 of the scorotron charger 30 and a grid electrode 62 for supplying electricity to the grid 38 of the scorotron charger 30 are buried in the top-left side plate 59 at a front position and a rear position, respectively. The top end surface of the top-left side plate 59 is formed by a horizontal portion that extends approximately horizontally in the front-rear direction and a slant portion that extends obliquely downward from the rear end of the horizontal portion.

As shown in FIG. 5, the right side wall 55 assumes a flat plate shape and is disposed on the right side of the drum main body 34. The top end surface of the right side wall 55, which is shaped so as to correspond to the top end surface of the top-left side plate 59, is formed by a horizontal portion that extends approximately horizontally in the front-rear direction and is in the same plane as the horizontal portion of the top end surface of the top-left side plate 59 and a slant portion that extends obliquely downward from the rear end of the horizontal portion and is in the same plane as the slant portion of the top end surface of the top-left side plate 59. The drum shaft 35 is inserted in the right side wall 55, and a right support hole 63 that is fitted with a bearing member 67 is formed through the right side wall 55 at a position corresponding to the position of the insertion hole 60 of the bottom-left side plate 57. The right side wall 55 is formed with, around the support hole 63, a spacer portion 201 that projects rightward (outward). The spacer portion 201 supports a disc portion 69 of the bearing member 67 in such a manner that a slight gap is formed between the disc portion 69 and the right side wall 55 in the right-left direction.

As shown in FIG. 3, the top wall 56 is provided with a top horizontal portion 64 and a top slant portion 65. The top horizontal portion 64 bridges the horizontal portion of the top end surface of the top-left side plate 59 and the horizontal portion of the top end surface of the right side wall 55. The top horizontal portion 64 is located over the photoreceptor 29. The top horizontal portion 64 is formed with a laser beam input window 641 that is generally rectangular in a plan view. The laser beam input window 641 is for input of a laser beam that comes from the scanner unit 19 and serves for a high-speed scan.

The top slant portion 65 bridges the slant portion of the top end surface of the top-left side plate 59 and the slant portion of the top end surface of the right side wall 55. The top slant portion 65 is separated from the top horizontal portion 64 by a prescribed interval in the front-rear direction and is located at a top-rear position with respect to the photoreceptor 29.

The top slant portion 65 is provided with the scorotron charger 30. More specifically, the discharge wire 37 is stretched between the top-left side plate 59 and the right side wall 55 approximately parallel with the top slant portion 65. The grid 38 extends approximately parallel with the top slant portion 65 and bridges the top-left side plate 59 and the right side wall 55.

The drum shaft 35 of the photoreceptor 29 is supported by the bottom-left side plate 57 and the right side wall 55 via the left and right bearing members 66 and 67, respectively.

Each of the bearing members 66 and 67 is made of a resin material such as a POM (polyacetal) resin, an ABS (acrylonitrile butadiene styrene) resin, or a PS (polystyrene) resin and has a shaft insertion portion 68, the disc portion 69, and a fixed portion 70 that are integral with each other.

The shaft insertion portion 68 has substantially the same diameter as the outer diameter of the drum shaft 35 and assumes such a cylindrical shape as to be fitted with the outer circumferential surface of the drum shaft 35.

Shaft end portions of the drum shaft 35 are inserted in the shaft insertion portions 68 of the right and left bearing members 66 and 67 (the shaft insertion portions 68 serve as bearings) and the drum shaft 35 is fitted in stoppers 78, whereby the drum shaft 35 is supported by the left side wall 54 and the right side wall 55 via the bearing members 66 and 67.

Two end portions of the drum shaft 35 project outward in the right-left direction. A ground (not shown) that is provided in the main body casing 2 to ground the drum shaft 35 is connected to the end portion of the drum shaft 35 that projects from the left bearing member 66 in a state that the process cartridge 20 is attached to the main body casing 2.

Between the bearing members 66 and 67, the drum shaft 35 is inserted in two flange members 79 and 80 that are disposed at two end positions (in the axial direction) of the drum shaft 35 and a drum gear 81 that is disposed at a left end position (in the axial direction) of the drum shaft 35 in such a manner that the drum shaft 35 can be rotated relatively to the flange members 79 and 80 and the drum gear 81. In this manner, the drum main body 34 is supported so as to be relatively rotatable via the flange members 79 and 80.

The flange members 79 and 80 are made of an insulative resin material, and are attached to the left-side end and the right-side end of the drum main body 34, respectively, so as not to be rotated relatively to the drum main body 34. Each of the flange members 79 and 80 is provided with a flange bearing portion 82 in which the drum shaft 35 is inserted, an insertion portion 83 that is inserted in the drum main body 34, and a flange connection portion 84 that connects the flange bearing portion 82 and the insertion portion 83. The flange bearing portion 82, the insertion portion 83, and the flange connection portion 84 are integral with each other.

The flange bearing portion 82 has substantially the same diameter as the outer diameter of the drum shaft 35, and assumes such a cylindrical shape as to be fitted with the outer circumferential surface of the drum shaft 35.

The insertion portion 83 has substantially the same diameter as the inner diameter of the drum main body 34, and assumes such a cylindrical shape as to be fitted in the inner circumferential surface of the drum main body 34.

The flange connection portion 84 assumes a ring plate shape so as to extend in the radial direction of the drum main body 34, that is, between the flange bearing portion 82 and the insertion portion 83.

The left-side flange member 79 is formed integrally with a flange-side coupling portion 85 to be coupled to the drum gear 81 (described later) and an output gear 86 to mesh with a transfer gear 112 (described later).

The flange-side coupling portion 85 projects leftward from the flange connection portion 84 at a halfway position in the radial direction.

The output gear 86 assumes a cylindrical shape that extends leftward from the insertion portion 83 so as to be continuous with the latter, and has plural outside teeth that mesh with the transfer gear 112 (described later) and project outward in the radial direction.

The drum gear 81 is disposed on the left side of the left-side flange member 79, and is provided with a gear bearing portion 87 in which the drum shaft 35 is inserted, an input gear 88 that meshes with a drive transmission gear (not shown), and a gear connection portion 89 that connects the gear bearing portion 87 and the input gear 88. The gear bearing portion 87, the input gear 88, and the gear connection portion 89 are molded so as to be integral with each other.

The gear bearing portion 87 has substantially the same diameter as the outer diameter of the drum shaft 35, and assumes such a cylindrical shape as to be fitted with the outer circumferential surface of the drum shaft 35.

The input gear 88 assumes a cylindrical shape, and has plural outside teeth that mesh with the drive transmission gear (not shown) and project outward in the radial direction.

The gear connection portion 89 assumes a ring plate shape in the radial direction, that is, between the hear bearing portion 87 and the input gear 88.

The gear connection portion 89 is integrally formed with a gear-side coupling portion 90 that projects rightward from the gear connection portion 89 at a halfway position in the radial direction and is to be coupled to the flange-side coupling portion 85 of the flange member 79.

The drum gear 81 is joined to the left-side flange member 79 so as not to be rotatable relatively to the latter. The gear-side coupling portion 90 and the flange-side coupling portion 85 of the left-side flange member 79 are in contact with each other so that the gear bearing portion 87 and the flange bearing portion 82 of the flange member 79 are opposed to each other in the axial direction.

The drum gear 81 may be integral with the left-side flange member 79.

The insertion portion 83 of the left-side flange member 79 is press-fitted in the drum main body 34 through its left-end opening, whereby the flange member 79 and the drum gear 81 are attached to a left-side end portion of the drum main body 34 so as not be rotatable relatively to the latter.

The insertion portion 83 of the right-side flange member 80 is press-fitted in the drum main body 34 through its right-end opening, whereby the flange member 80 is attached to a right-side end portion of the drum main body 34 so as not be rotatable relatively to the latter.

Attached in the above manner, the flange members 79 and 80 are attached to the two respective end portions (in the axial direction) of the drum main body 34 so as not be rotatable relatively to the latter while being supported so as to be rotatable relatively to the drum shaft 35. Therefore, the photoreceptor 29 is rotatably supported by the drum shaft 35 via the flange members 79 and 80.

The right side wall 55 which is opposed to the right-side flange member 80 is provided with, between itself and the right-side flange member 80, a spring receiving member 91 in which the drum shaft 35 is inserted and a spring 202 that is received by the spring receiving member 91.

The spring receiving member 91 has a generally bracket-shaped cross section that is open on the left side, and is supported by the inner surface of the right side wall 55. The spring 202, which is provided around the drum shaft 35, urges the flange member 80 leftward in a state that it is received by the spring receiving member 91. As a result, the drum gear 80 which is joined to the left-side flange member 79 is brought in contact with the bottom-left side plate 57, whereby the photoreceptor 29 is positioned in the axial direction.

When drive force is transmitted from a motor (not shown) provided in the main body casing 2 to the drive transmission gear (not shown), the input gear 88 that is in mesh with the drive transmission gear is driven rotationally, whereby the photoreceptor 29 is rotated.

The bottom frame 28 is provided with a pair of side walls 92 (see FIG. 5), a rear connection portion 93 that connects rear end portions of the side walls 92, and a front bottom connection portion 94 and a rear bottom connection portion 95 (see FIG. 6). The side walls 92, the rear connection portion 93, the front bottom connection portion 94, and the rear bottom connection portion 95 are integral with each other. As such, the bottom frame 28 is open at the top.

The left side wall 92 is formed with an opening 111 through which a transfer electrode 113 (described later) is exposed.

The left side wall 92 is provided with a cleaning electrode 104 for applying a cleaning bias to the cleaning brush 33.

As shown in FIG. 6, the rear connection portion 93 connects the rear end portions of the pair of side walls 92. A counter wall 105 that is disposed behind and opposed to the photoreceptor 29 erects from the rear connection portion 93, and the cleaning brush 33 is attached to the counter wall 105.

The front bottom connection portion 94 connects front portions of the bottom ends of the pair of side walls 92. The front bottom connection portion 94 is provided with a registration roller accommodation portion 106 that accommodates the one (upper) registration roller 14.

As shown in FIG. 4, the rear bottom connection portion 95 connects rear portions of the bottom ends of the pair of side walls 92. As shown in FIG. 6, the rear bottom connection portion 95 is provided with a transfer roller accommodation portion 107 that accommodates the transfer roller 32. As shown in FIG. 5, the rear bottom connection portion 95 is also provided with a roller shaft receiving portions 109 that receive two respective end portions of the roller shaft 108 of the transfer roller 32.

The two end portions of the roller shaft 108 are received by the roller shaft receiving portions 109, whereby the transfer roller 32 is rotatably supported by the rear bottom connection portion 95.

The roller shaft 108 of the transfer roller 32 projects outward (i.e., rightward and leftward) from the roller shaft receiving portions 109, and the projected end portions are covered with respective cover members 110 made of an insulative resin material. This prevents the roller shaft 108 from being exposed near the right and left end portions of the drum main body 34, and hence can prevent a discharge from the roller shaft 108 to the drum main body 34 during application of a transfer bias.

The left-side end portion of the roller shaft 108 is covered with the transfer electrode 113 for application of a transfer bias. The transfer electrode 113 is exposed to the left side (outside) through the hole 111 in the left side wall 92.

The transfer gear 112 is attached to the roller shaft 108 between the cover member 110 and the transfer electrode 113 for the roller shaft 108 so as not to be rotatable relatively to the roller shaft 108. The transfer gear 112 has plural outside teeth that mesh with the output gear 86 of the left-side flange member 79 and project outward in the radial direction. With this structure, when the photoreceptor 29 is rotated by drive force supplied from the motor (not shown) that is provided in the main body casing 2, the output gear 86 of the left-side flange member 79 which is attached to the photoreceptor 29 is rotated. Therefore, the transfer gear 112 which is in mesh with the output gear 86 is driven rotationally and the transfer roller 32 is rotated.

2. Inflow Suppressing Member

Figure 7:
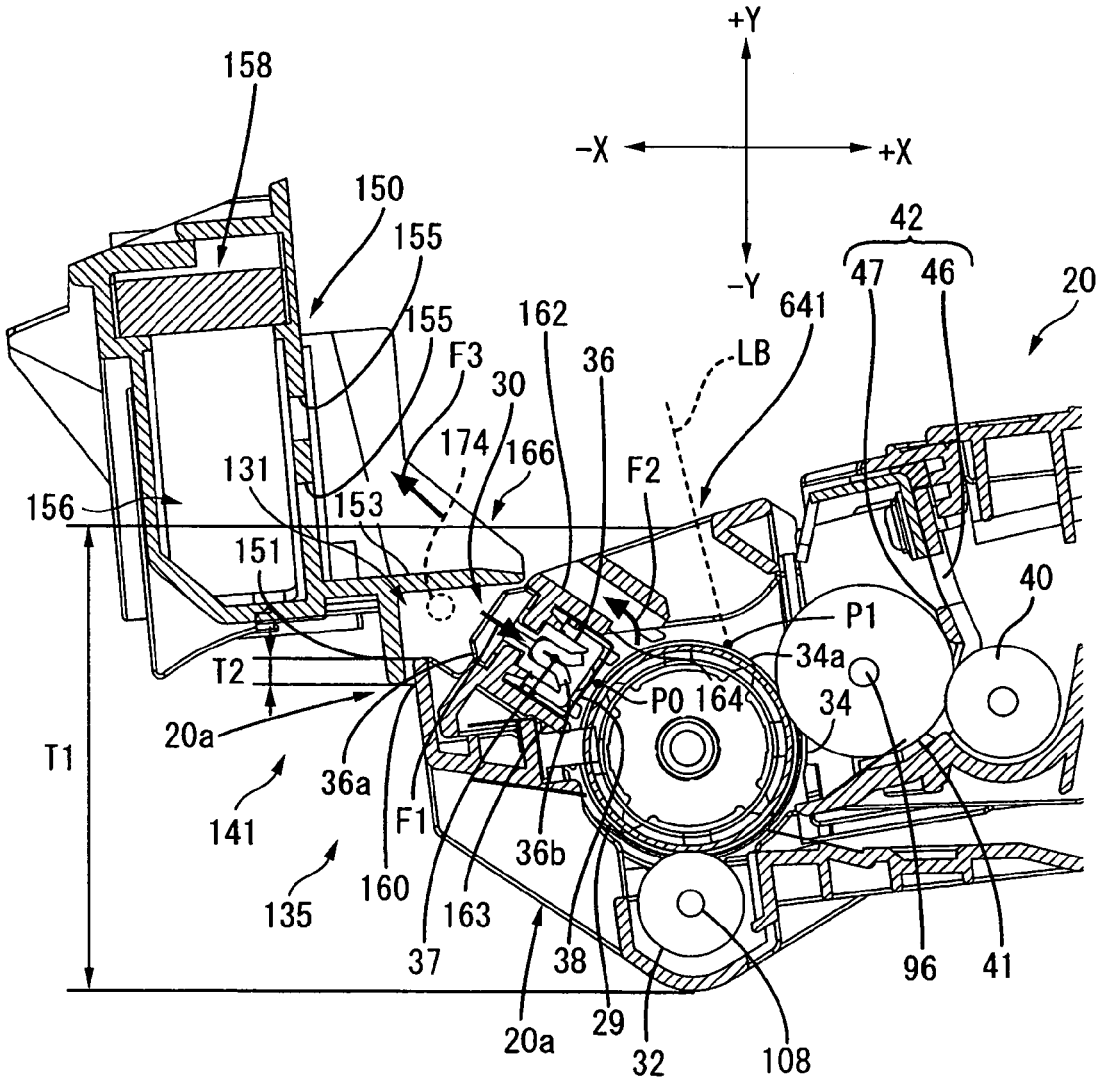
FIG. 7 is an enlarged explanatory view of part of FIG. 6.

As shown in FIGS. 6 and 7, a charger-side space 131 is formed around the charger 30. As shown in FIGS. 1 and 2, the charger-side space 131 is a space formed by the inner surface of a cartridge accommodation portion 130 that accommodates the process cartridge 20 and the outer surface of the charger 30. On the other hand, a fixing member-side space 141 is formed on the side of the fixing member 21. The fixing member-side space 141 is a space that is formed around the fixing member 21 by a fixing member accommodation portion 140 that communicates with the cartridge accommodation portion 130 via an opening 135. The fixing member accommodation portion 140 is formed by portions that surround the fixing member 21 (i.e., a bottom portion 140*a* (see FIG. 1), a ceiling portion 140*b* (see FIG. 2), and side frames 172 and 173 (see FIG. 11)).

As shown in FIG. 7, a closing rib 160 for increasing the closed area of the opening 135 is provided on an outer surface of the process cartridge 20 that is closer to the fixing member 21 (see FIG. 1) than the charger 30 is. The closing rib 160 separates the charger-side space 131 and the fixing member-side space 141 from each other and functions to suppress inflow of air into the charger-side space 131 from the fixing member-side space 141. As shown in FIG. 1, the opening 135 is closed by the outer surface of the process cartridge 20 and the presence of the closing rib 160 increases the closed area of the opening 135. The closing rib 160 corresponds to the inflow suppressing member.

That is, the opening 135 that connects the charger-side space 131 and the fixing member-side space 141 is closed by an outer surface of the process cartridge 20. Therefore, the opening 135 is made large and a configuration that facilitates maintenance of the fixing member 21 and components around the fixing member 21 can be realized easily.

As shown in FIG. 3, the closing rib 160 is formed parallel with the longitudinal direction of the discharge wire 37 (in the Z-axis direction in FIG. 3). In the embodiment, the Z-axis direction, the X-axis direction, and the Y-axis direction are defined as the longitudinal direction of the discharge wire 37, the front-rear direction of the laser printer 1, and the height direction of the laser printer 1, respectively. The closing rib 160 is provided so as to cover, in the longitudinal direction (Z-axis direction), at least the entire stretched region C2 where the discharge wire 37 is stretched.

Figure 8:
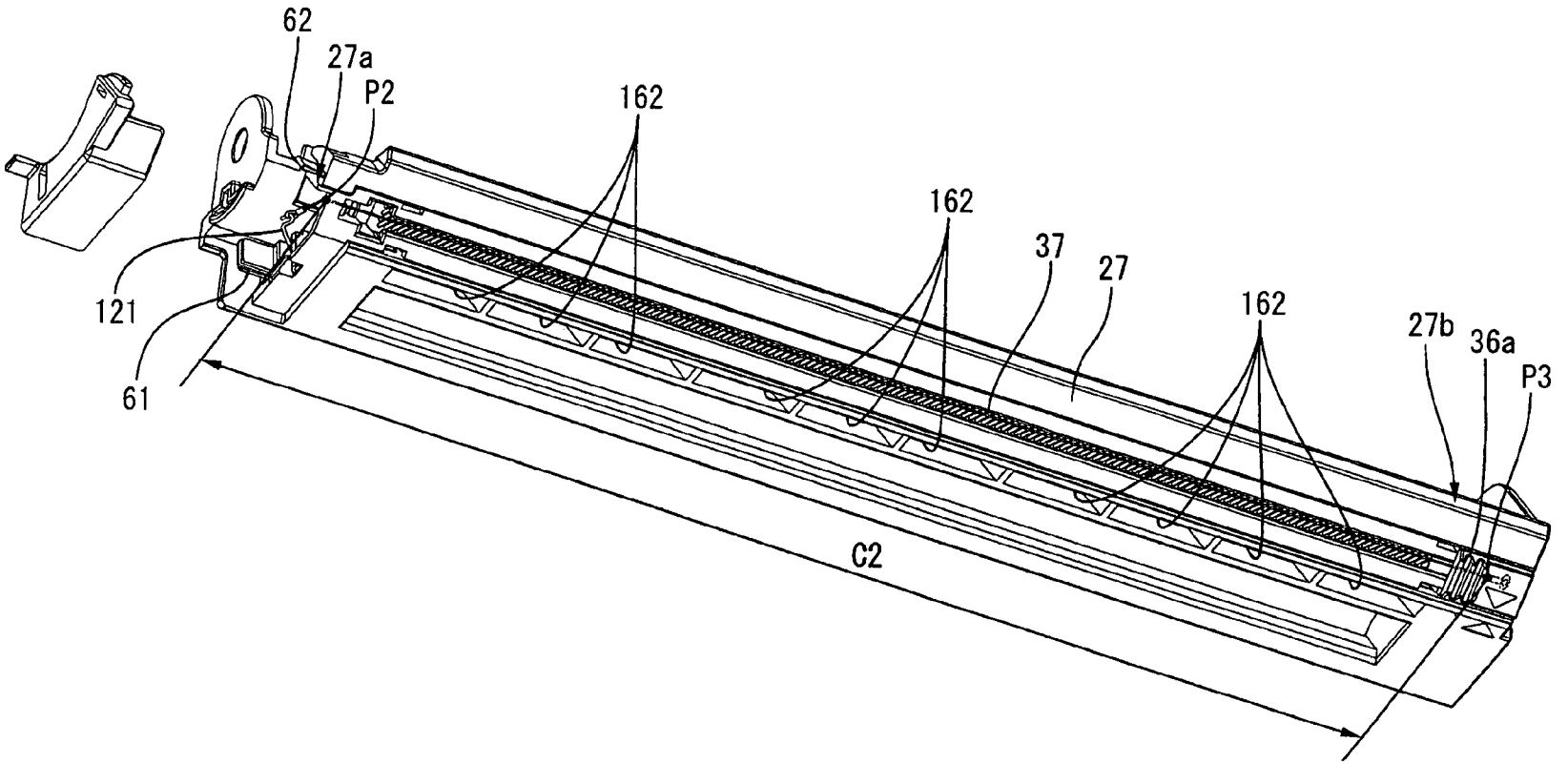
FIG. 8 is a perspective view showing the internal structure of a top frame and illustrating a discharge wire stretching structure.

As shown in FIG. 8, the discharge wire 37 is stretched at proper tension in such a manner that its one end is connected to the top frame 27 and the other end is pulled by a torsion coil spring 121 as an urging member. The top frame 27 is formed with a pair of support walls 27*a* and 27*b* that support the discharge wire 37. The positions where the pair of support walls 27*a* and 27*b* support the discharge wire 37 are support positions P2 and P3, and the region extending in the longitudinal direction between the support positions P2 and P3 is the stretched region C2 (also see FIG. 3).

That is, as shown in FIG. 3, the two ends of the closing rib 160 are located outside the respective support positions P2 and P3 of the discharge wire 37 in its longitudinal direction so that a closing rib 160 formation region C1 covers the entire stretched region C2 in the longitudinal direction of the discharge wire 37. From another point of view, the closing rib 160 is formed so as to cover the entire printing region of the photoreceptor 29 in the longitudinal direction of the discharge wire 37 (Z-axis direction). That is, the two ends of the closing rib 160 are located outside the respective ends, in the longitudinal direction, of the printing region so that the closing rib 160 formation region C1 covers the entire printing region (i.e., the region to be subjected to exposure by an exposing unit) of the photoreceptor 29 in the longitudinal direction.

As shown in FIG. 7, the charger 30 is equipped with the above-mentioned wiper 36, which is provided with a manipulation portion 36*a* and a cleaning member 36*b* that is moved together with the manipulation portion 36*a*. The wiper 36 is configured in such a manner that when the manipulation portion 36*a* is manipulated, the cleaning member 36*b* is slid in the stretched direction (Z-axis direction (see FIG. 3)) of the discharge wire 37 and the discharge wire 37 is thereby cleaned. The wiper 36 is provided so as to be movable in the right-left direction in a state that the cleaning member 36*b* holds the discharge wire 37 from both sides. The discharge wire 37 can be cleaned by moving the wiper 36 in the right-left direction.

For the above-configured wiper 36, the closing rib 160 is provided so as not to cover the manipulation portion 36*a*. The closing rib 160 is separated from the manipulation portion 36*a* of the wiper 36 by a prescribed distance and is disposed closer to the rear side (the side of the fixing member 21) than the manipulation portion 36*a* is. More specifically, in a plane (XY plane) that is perpendicular to the longitudinal direction, no part of the closing rib 160 exists on the side of the manipulation portion 36*a* opposite to the photoreceptor 29 in the opposed direction in which the photoreceptor 29 and the discharge wire 37 are opposed to each other and the manipulation portion 36*a* and the closing rib 160 are separated from each other by the prescribed distance in the direction perpendicular to the opposed direction. That is, in the direction perpendicular to the opposed direction, the closing rib 160 is disposed in the different region than the manipulation portion 36*a* is.

A rear end portion of the process cartridge 20 has a tapered portion 20*a* whose thickness decreases as the position comes closer to the fixing member 21, and the closing rib 160 projects so as to go in a region T1 that is the same in thickness as the proximal portion of the tapered portion 20*a* in the thickness direction of the process cartridge 20. The term "proximal portion of the tapered portion 20*a*" means a portion of the tapered portion 20*a* that is located on the proximal side and has a maximum thickness. In the embodiment, the thickness direction is the height direction of the laser printer 1 (the Y-axis direction in FIG. 7) and the closing rib 160 projects upward.

An opening rib 151 that projects in the direction opposite to the projection direction of the closing rib 160 is provided so as to define part of the opening 135 through which the cartridge accommodation portion 130 (see FIG. 2) and the fixing member accommodation portion 140 (see FIG. 2) communicate with each other. The opening rib 151 disposition region overlaps with the closing rib 160 disposition region in the projection direction of the closing rib 160 (Y-axis direction). That is, an overlap region T2 where the ribs 151 and 160 are arranged in the front-rear direction exists in the projection direction (Y-axis direction).

According to the configuration, the closing rib 160 does not project beyond the region that is the same in thickness as the proximal portion. Therefore, this configuration can effectively lower the probability of occurrence of handling-related trouble such as damage of the closing rib 160 and getting caught on the closing rib 160.

With the above structure, even if pollutants such as silica are scattered from around the fixing member 21, air containing such substances is not prone to flow from the fixing member 21 side to the charger 30 side, which prevents pollution of the discharge wire 37 effectively. As a result, the wire thickness can be kept uniform and hence discharge unevenness becomes less prone to occur. The image quality can thus be increased.

3. Air Flow Generating Unit

Figure 10:
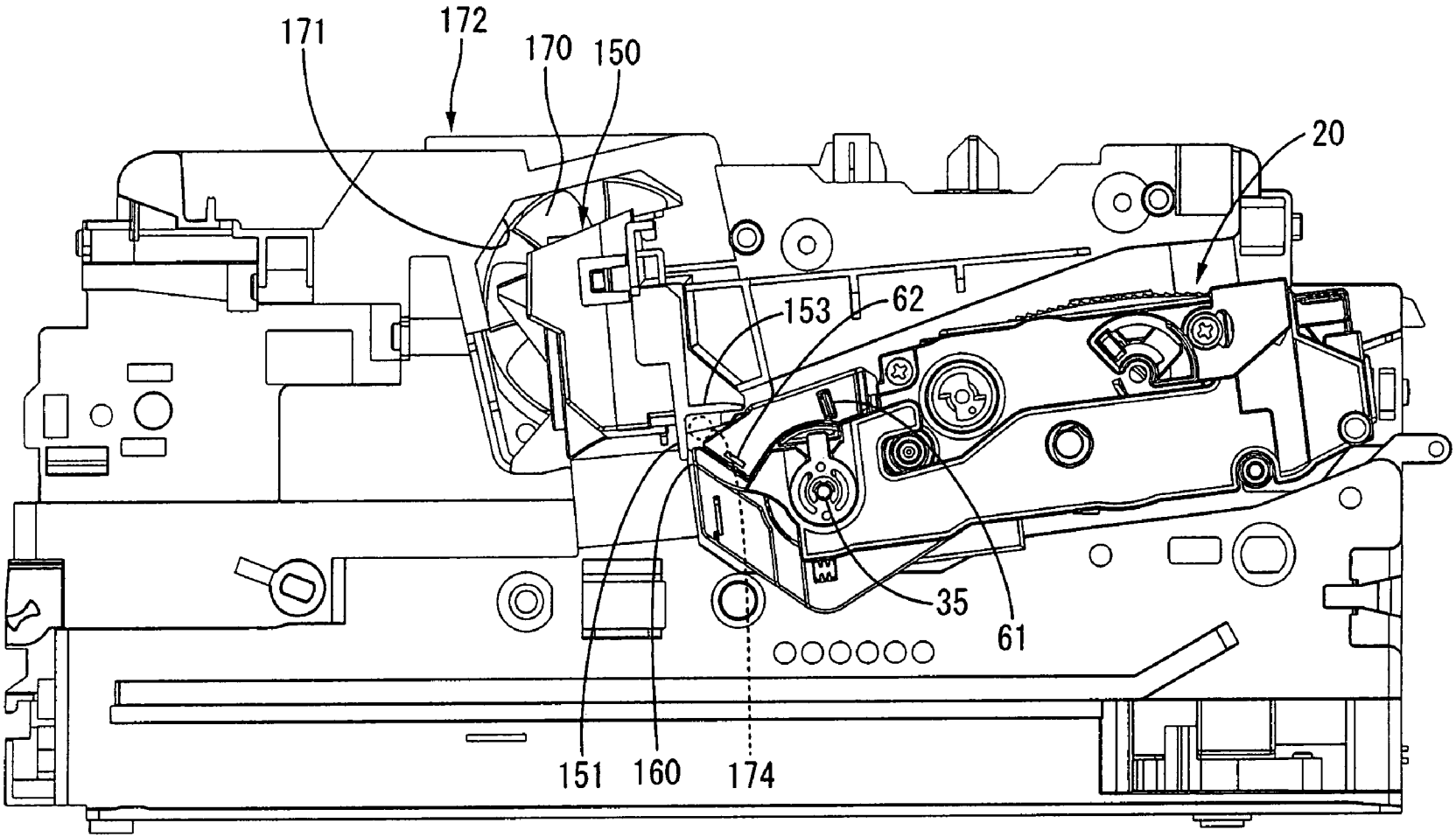
FIG. 10 is a side view corresponding to FIG. 9 and showing the arrangement of the process cartridge, the duct, and the one frame.
Figure 11:
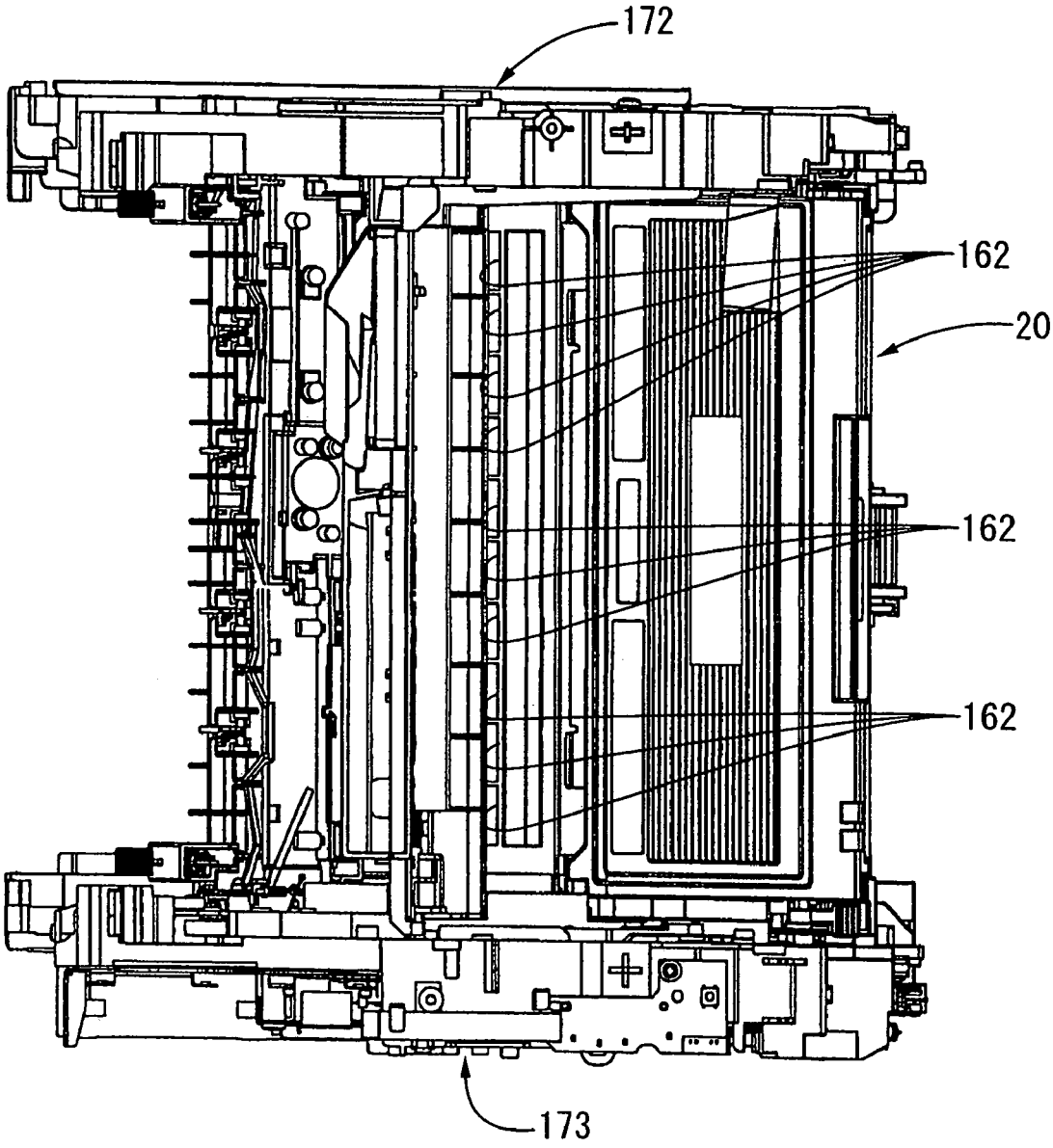
FIG. 11 is a plan view showing the arrangement of the process cartridge, the duct, and both frames.

In the laser printer 1, as shown in FIG. 11, the wall-shaped frames 172 and 173 are disposed on both sides in the longitudinal direction of the discharge wire 37 so as to be opposed to each other. The charger-side space 131 shown in FIG. 7 communicates with the outside of the laser printer 1 via an air passage hole 174 that is formed through the frame 172. The charger-side space 131 is a long space that is surrounded in four directions (top, bottom, right, and left) by the opening rib 151, a partition 153 (described later), the closing rib 160, and the charger 30 and that extends parallel with the longitudinal direction of the discharge wire 37 (i.e., in the Z-axis direction (see FIG. 3)). And the charger-side space 131 is surrounded on both sides by the frames 172 and 173. The air passage hole 174 (see FIGS. 7 and 10) is formed through the frame 172 that is disposed on the one side.

Figure 9:
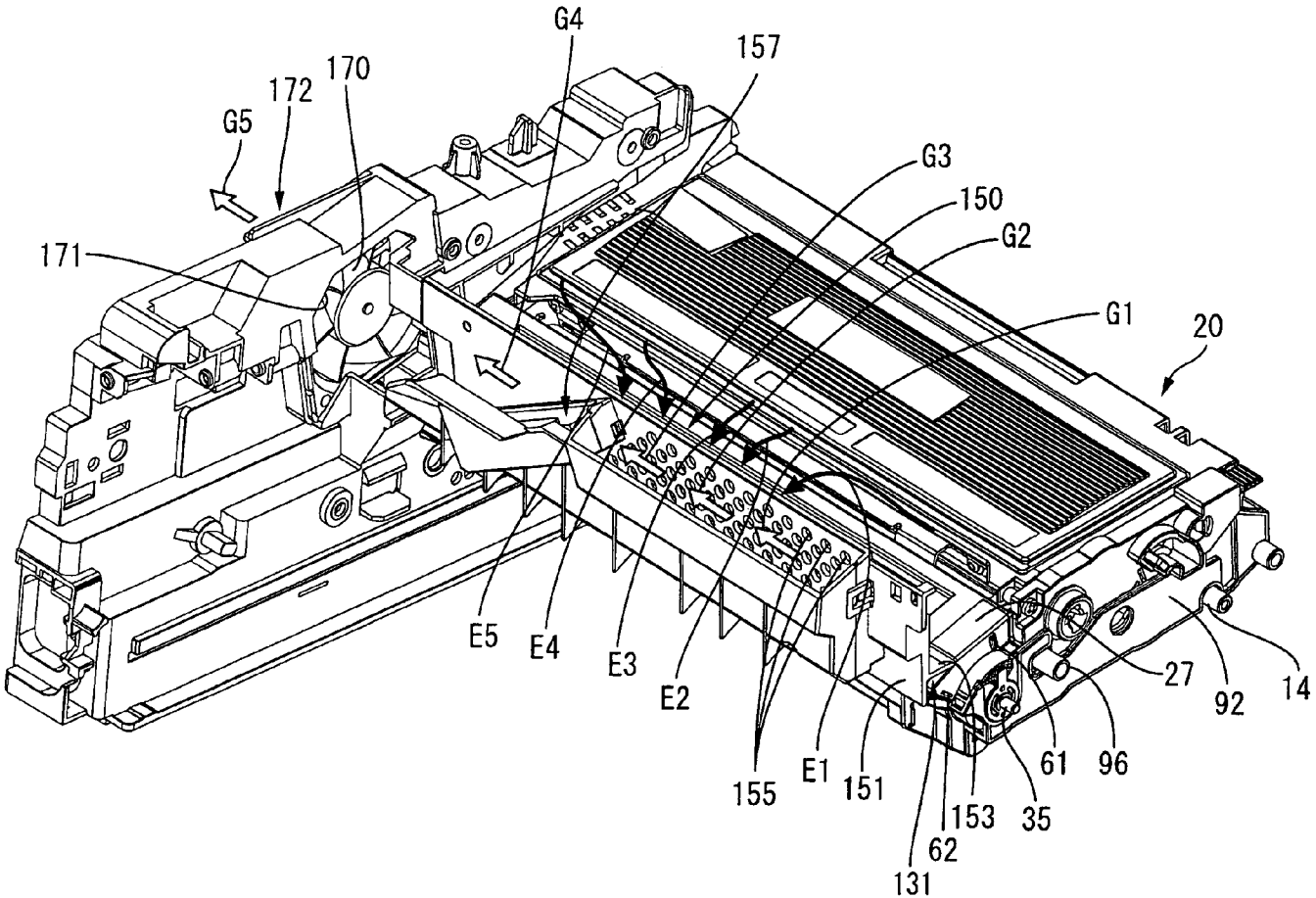
FIG. 9 is a perspective view showing the arrangement of the process cartridge, a duct, and one frame.

As shown in FIGS. 9 and 10, a fan 170 for sucking air from the charger-side space 131 and generating an air flow that is directed from the charger 30 to the photoreceptor 29 is provided in the frame 172 at a position that is separated from the air passage hole 174 by a prescribed distance. The fan 170 corresponds to the air flow generating unit. The fan 170 communicates with the charger-side space 131 via a duct 150 (described later), air passages 162, and the charger 30, and functions to suck air from the charger-side space 131 and generate an air flow that is directed from the charger 30 to the photoreceptor 29.

As shown in FIG. 7, the air passages 162 for guiding an air flow that has flown from the charger 30 to the photoreceptor 29 in such a direction that it goes away from the photoreceptor 29 are provided between a charging position P0 where the charger 30 is opposed to the photoreceptor 29 and an exposure position P1 of the exposing unit (i.e., a laser beam LB application position) on the outer circumferential surface 34*a* of the drum main body 34 of the photoreceptor 29. The charger 30 is provided with a pair of support wails 163 and 164 that extend parallel with the longitudinal direction of the discharge wire 37 and are disposed to face with each other. Air flows through the inside of the support walls 163 and 164 from the charger-side space 131 to the photoreceptor 29, U-turns near the outer circumferential surface 34*a*, and is then guided out through the air passages 162. In FIG. 7, an air flow coming from the charger-side space 131 is indicated conceptually by arrows F1, F2, and F3. With the thus-formed air passages 162, ions generated by corona discharge are less prone to hit exposed portions of the photoreceptor 29, which prevents re-charging of the exposed portions. This makes it possible to effectively prevent image quality deterioration due to such re-charging.

Air that is guided out through the air passages 162 is sent to a space 166 that is located outside the process cartridge 20 and separated from the charger-side space 131, and is then ejected to the outside via the duct 150 and an ejection hole 171. The charger-side space 131 and the space 166 are separated from each other by the partition 153 that extends in the longitudinal direction and closes the charger-side space 131 from above. The partition 153 functions as a re-entry preventing member for preventing an air flow that has flown from the charger 30 to the photoreceptor 29 from flowing into the charger-side space 131 again.

The laser printer 1 is provided with the ejection hole 171 through which air that has flown from the charger-side space 131 to the photoreceptor 29 is ejected to the outside of the laser printer 1. As shown in FIG. 7, the duct 150 is configured as a flow passage for taking, through plural intermediary holes 155, air that has been guided out through the air passages 162 and exists in the space 166 located over the partition 153 and for guiding the air to the ejection hole 171.

Figure 12:
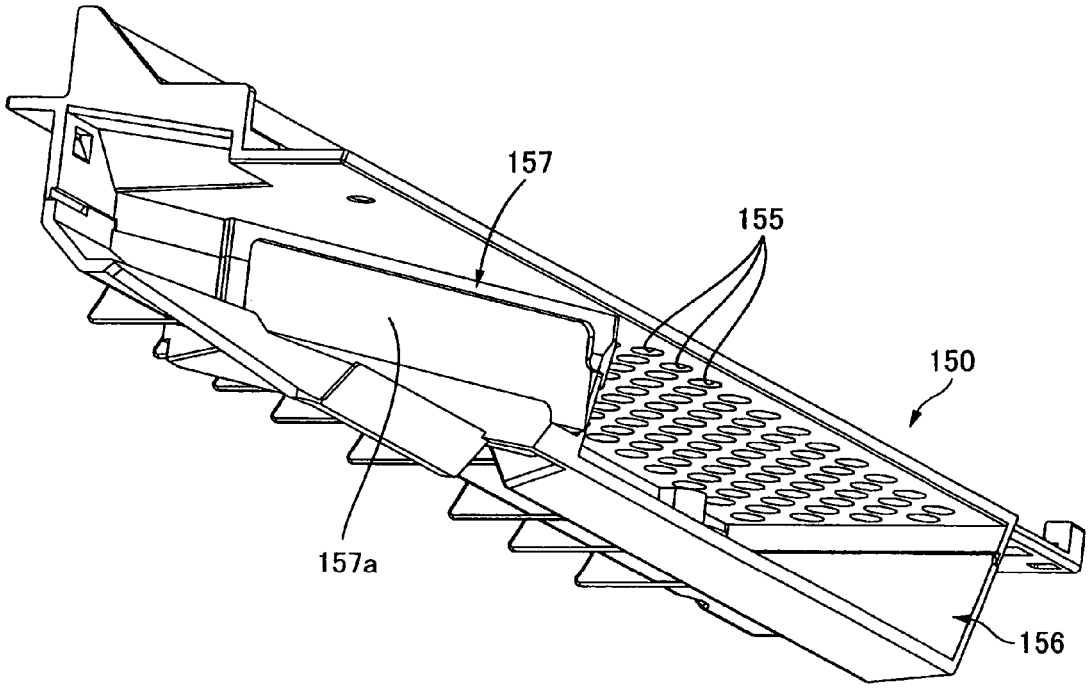
FIG. 12 is a perspective view illustrating the internal structure of the duct.

The air passage hole 174 and the ejection hole 171 are formed in only the frame 172 of the frames 172 and 173 that are opposed to each other. The intermediary holes 155 of the duct 150 are formed at a position in the longitudinal direction that is closer to the frame 173 in which the air passage hole 174 and the ejection hole 171 are not formed so that air that has flown from the charger-side space 131 to the photoreceptor 29 goes through the intermediary holes 155. Having an internal flow passage 156, the duct 150 is configured so as to guide air that has entered through the air passage hole 174 and passed through the intermediary holes 155 to the ejection hole 171 along a path that does not pass the charger-side space 131. As shown in FIG. 12, an ozone filter 157 is disposed in the duct 150 between the intermediary holes 155 and the ejection hole 171. The ozone filter 157 is disposed in such a manner that a filter outer surface 157*a* is inclined from the air flow direction (in the example of FIGS. 9 and 12, from the longitudinal direction of the discharge wire 37), and functions to remove ozone that is generated by corona discharge in FIGS. 9 and 12, a top cover 158 (see FIG. 7) is omitted to show the internal structure of the duct 150. In FIG. 9, flows of air that is taken from the space 166 (see FIG. 7) through the plural intermediary holes 155 are indicated conceptually by arrows E1-E5 and flows of air that is ejected through the ejection hole 171 past the ozone filter 157 after being taken through the plural intermediary holes 155 are indicated by arrows G1-G5.

As shown in FIGS. 9 and 10, in the laser printer 1, the driving mechanism for driving the photoreceptor 29 is disposed on the side (frame 173 side (see FIG. 11)) where the air passage hole 174 and the ejection hole 171 are not provided. The above-described drum gear 81 and the motor (not shown) constitute the driving mechanism. In the laser printer 1, the wire electrode 61 for supplying electric power to the discharge wire 37 and the grid electrode 62 are provided on the frame 173 side (also see FIG. 8). A high-voltage power circuit board (not shown) capable of applying high voltages is attached to the frame 173 so as to be electrically connected to the wire electrode 61 and the grid electrode 62. The high-voltage power circuit board corresponds to the supply mechanism. The high-voltage power circuit board is provided with a power circuit (not shown) capable of applying high voltages, and plural electricity supply members (not shown) that are conductive and elastic wires electrically connected to the power circuit are provided on the inner surface of the frame 173. These electricity supply members can contact the wire electrode 61 and the grid electrode 62, respectively, in a state that the process cartridge 20 is attached, and voltages of the power circuit are applied via the individual electricity supply members.

As described above, the above-mentioned motor, high-voltage power circuit board, etc. are provided and various related components are arranged at a high density on the frame 173 side. Therefore, it is difficult to provide the above-mentioned air passage hole 174 and ejection hole 171 on the frame 173 side. However, the configuration of the embodiment enables an efficient arrangement because the air passage hole 174 and the ejection hole 171 are concentrated on the frame 172 side and the above-mentioned driving mechanism and supply mechanism are provided on the opposite side, that is, on the frame 173 side. Accordingly, miniaturization of the image forming apparatus 1 may be improved.

Other Embodiments

The configuration of the laser printer 1 is not limited to the first embodiment described above with reference to the drawings. For example, the following configuration is also included in the technical scope of the invention and, in addition, various modifications are possible without departing from the spirit and scope of the invention.

(1) Although in the above embodiment the air flow generating unit is formed by using the fan 170, the air flow generating unit may be formed only by the scorotron charger 30 (the fan 170 is not used). That is, the air flow generating unit may be formed in such a manner that an air flow is generated by a spontaneous flow of ions generated by corona discharge (ion wind).

According to this configuration, since the scorotron charger has both of the charging function and the air flow generating function, a configuration capable of generating an air flow can be realized easily without cost increase.

Second Embodiment

1. Total Configuration

Figure 13:
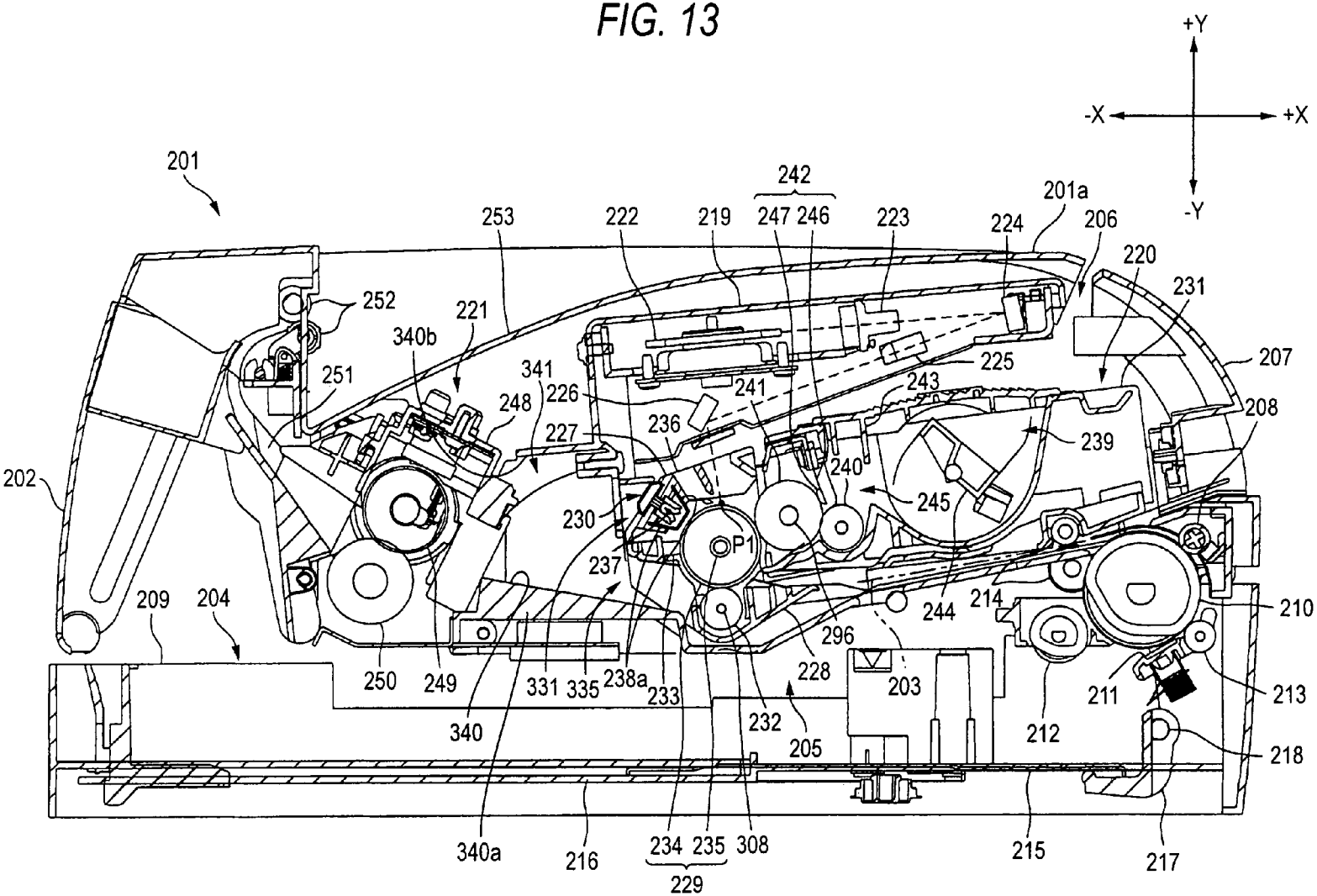
FIG. 13 is a side sectional view of a substantial part of a laser printer as an image forming apparatus according to a second embodiment in a state that a front cover is closed.
Figure 14:
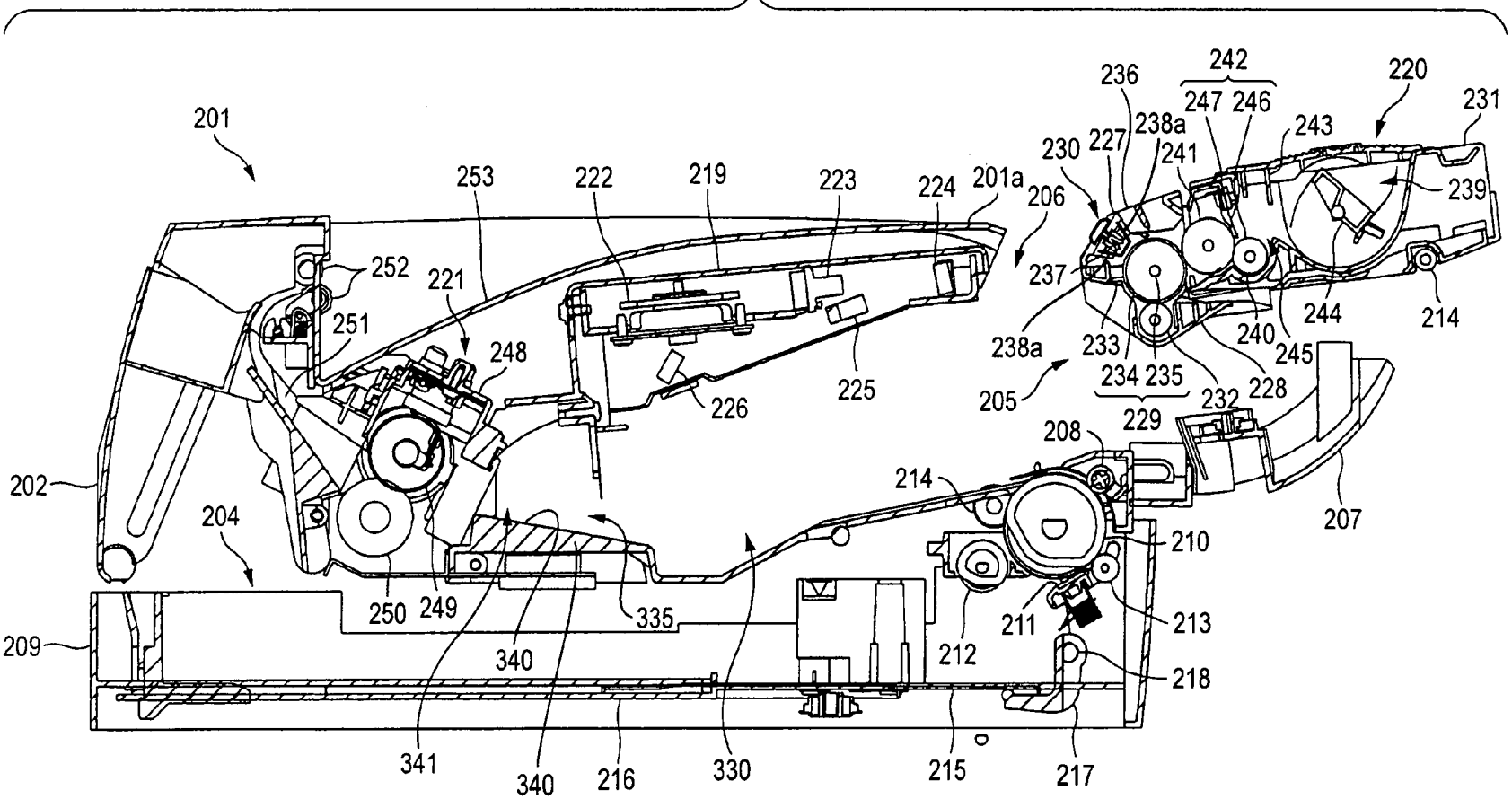
FIG. 14 is a side sectional view of the substantial part of the laser printer of FIG. 13 in a state that the front cover is opened.
Figure 15:
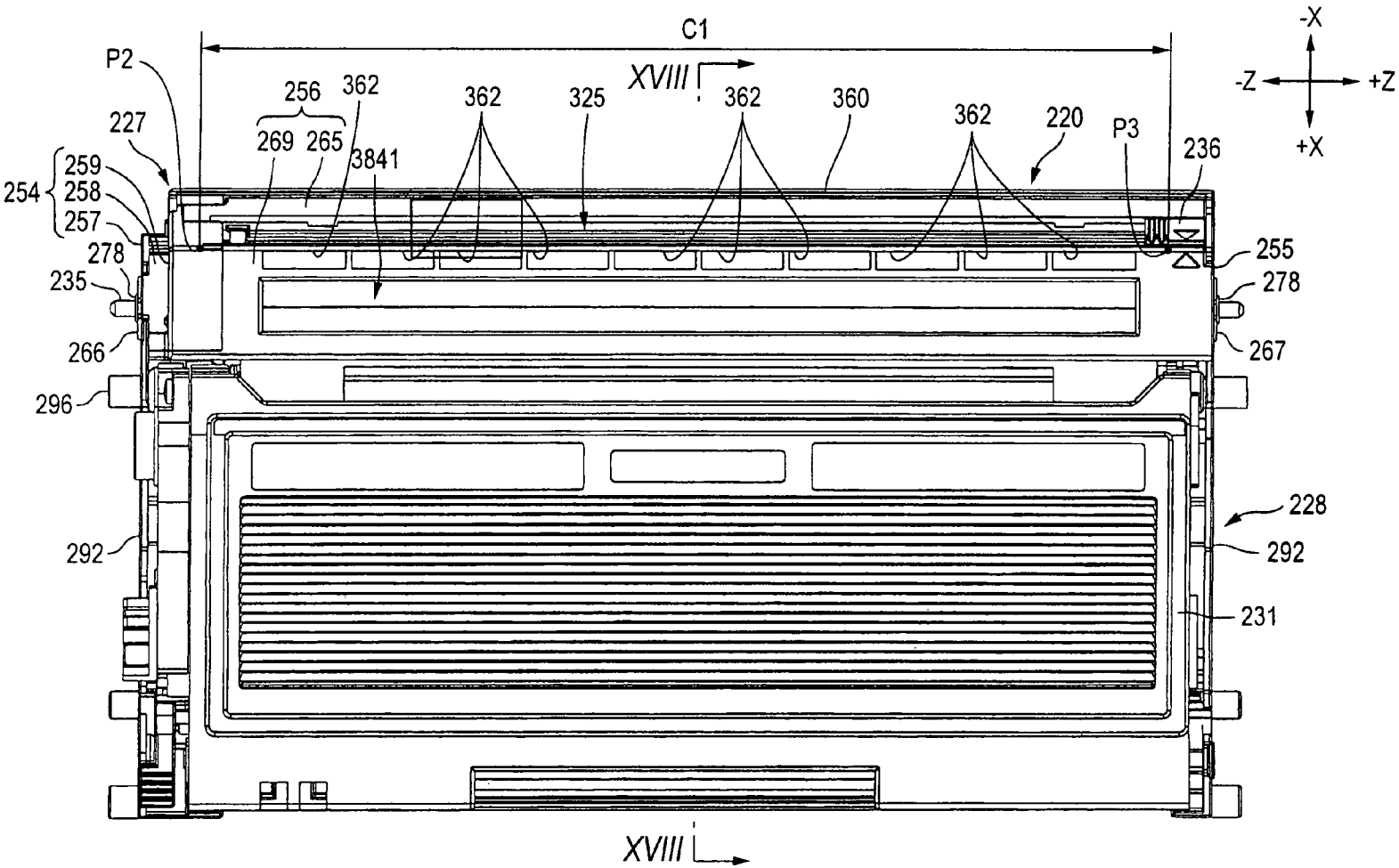
FIG. 15 is a plan view of a process cartridge shown in FIG. 13.
Figure 16:
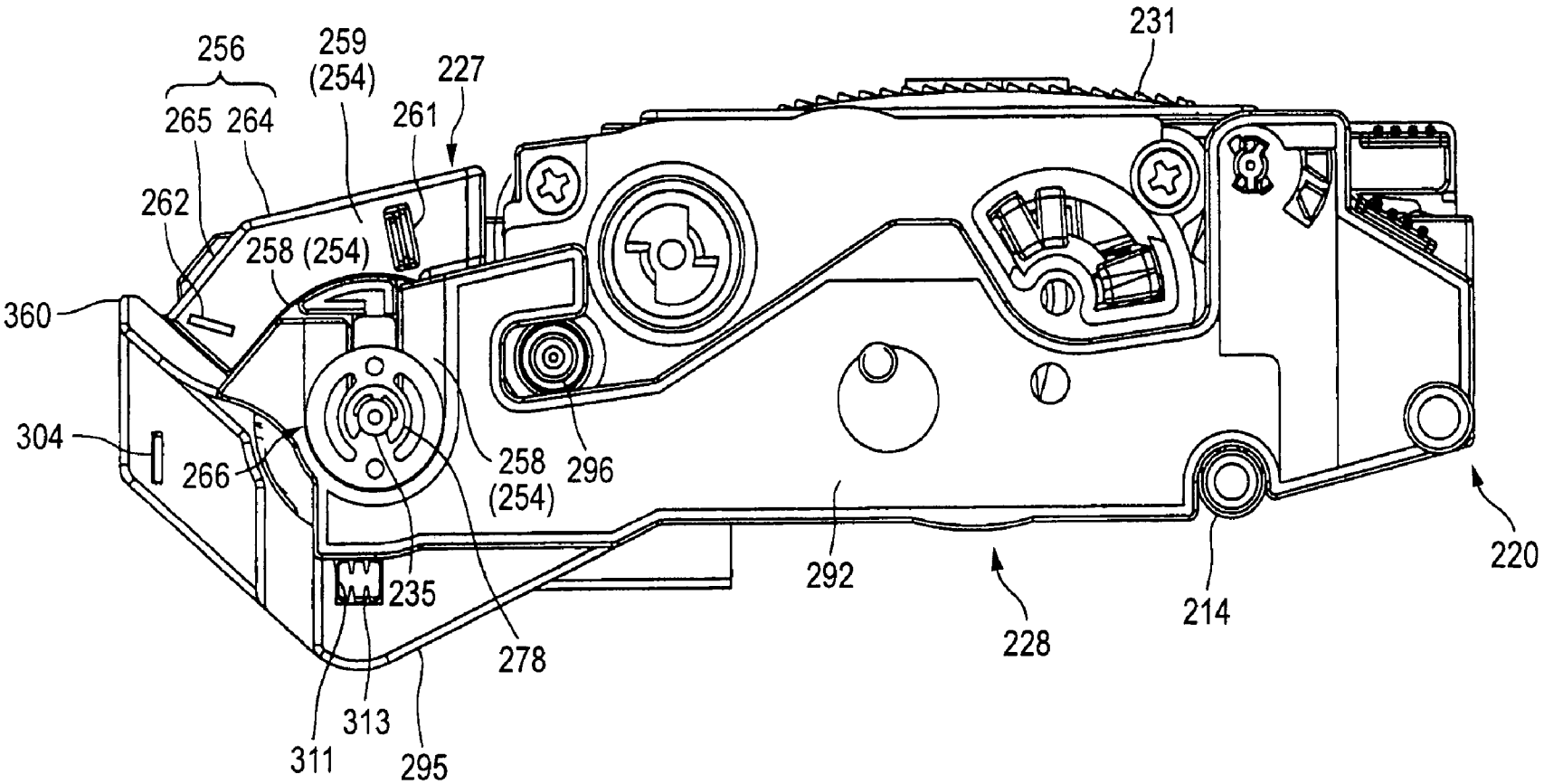
FIG. 16 is a side view of the process cartridge shown in FIG. 13.
Figure 17:
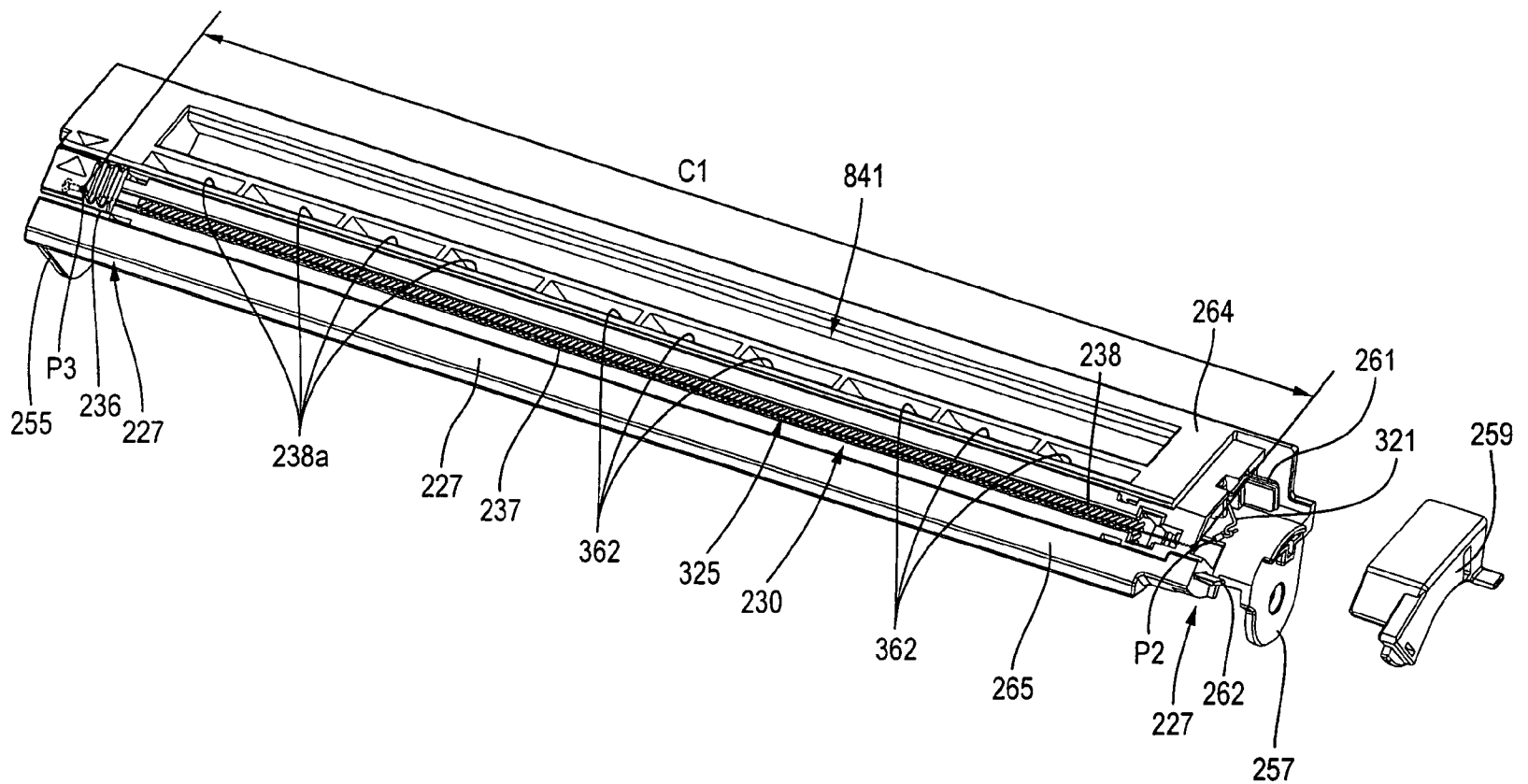
FIG. 17 is a perspective view showing the internal structure of a top frame and illustrating a discharge wire stretching structure.

FIGS. 13 and 14 are side sectional views of a substantial part of a laser printer as an image forming apparatus according to a second embodiment of the invention. FIG. 15 is a plan view of a process cartridge. FIG. 16 is a side view of the process cartridge. FIG. 17 is a perspective view showing the internal structure of a top frame and illustrating a discharge wire stretching structure.

The laser printer 201 is equipped with a main body casing 202, a feeder unit 204 for supplying a sheet 203 as a recording subject medium, an image forming unit 205 for forming an image on the sheet 203 supplied, and other units and components. The feeder unit 204 and the image forming unit 205 are housed in the main body casing 202.

A front wall of the main body casing 202 is formed with an attachment/detachment opening 206 for attachment and detachment of a process cartridge 220 (described later) as well as a front cover 207 for opening and closing the attachment/detachment opening 206. The front cover 207 is rotatably supported by a cover shaft (not shown) that is inserted in a bottom end portion of the front cover 207. With this structure, when the front cover 207 is closed by rotating it about the cover shaft, the attachment/detachment opening 206 is closed by the front cover 207 as shown in FIG. 13. If the front cover 207 is opened (inclined) with the cover shaft serving as a supporting point, the attachment/detachment opening 206 is opened as shown in FIG. 14, whereby the process cartridge 220 can be attached to or detached from the main body casing 202 through the attachment/detachment opening 206. In the laser printer 201, a main body part other than the process cartridge 220 is an apparatus main body 201*a*.

In the embodiment, the side where the front cover 207 is provided will be called "front side" and the side opposite to it will be called "rear side" (see FIG. 13). Further, in the following description, the X-axis direction, the Y-axis direction, and the Z-axis direction are defined as the front-rear direction of the laser printer 201, the height direction of the laser printer 201, and the longitudinal direction of a discharge electrode, respectively.

The feeder unit 204 is equipped with a sheet supply tray 209 that is attached to a bottom portion of the main body casing 202 detachably, a sheet feed roller 210 and a separation pad 211 that are disposed above a front end portion of the sheet supply tray 209, a pickup roller 212 that is disposed behind the sheet feed roller 210, a pinch roller 213 that is disposed at a bottom-front position with respect to the sheet feed roller 210 so as to be opposed to the sheet feed roller 210, a paper powder removal roller 208 that is disposed at a top-front position with respect to the sheet feed roller 210 so as to be opposed to the sheet feed roller 210, and registration rollers 214 that are disposed at a top-rear position with respect to the sheet feed roller 210.

A sheet pressing plate 215 on which sheets 203 can be stacked is provided inside the sheet supply tray 209. With its rear end portion supported swingably, the sheet pressing plate 215 can be swung between a placement position where its front end portion is located below and it extends parallel with a bottom plate 216 of the sheet supply tray 209 and a transport position where its front end portion is located above and it is inclined.

A lever 217 for lifting up the front end portion of the sheet pressing plate 215 is disposed in a front end portion of the sheet supply tray 209. The lever 217 has a generally L-shaped cross section and extends from in front of the sheet pressing plate 215 to below it. A top end portion of the lever 217 is attached to a lever shaft 218 that is disposed in the front end portion of the sheet supply tray 209 and a rear end portion of the lever 217 is in contact with a front end portion of the bottom surface of the sheet pressing plate 215. With this structure, when clockwise (as viewed in the figures) rotational drive force is applied to the lever shaft 218, the lever 217 is rotated with the lever shaft 218 as a supporting point. The rear end portion of the lever 217 lifts up the front end portion of the sheet pressing plate 215, whereby the sheet pressing plate 215 is moved to the transport position.

When the sheet pressing plate 215 is moved to the transport position, the sheets 203 on the sheet pressing plate 215 are pressed against the pickup roller 212 and sheets start to be transported toward the boundary between the sheet feed roller 210 and the separation pad 211 by rotation of the pickup roller 212.

On the other hand, when the sheet supply tray 209 is detached from the main body casing 202, the front end portion of the sheet pressing plate 215 lowers due to its own weight and the sheet pressing plate 215 is moved to the placement position. In a state that the sheet pressing plate 215 is located at the placement position, sheets 203 can be stacked on the sheet pressing plate 215.

The sheets 203 that have been sent out toward the boundary between the sheet feed roller 210 and the separation pad 211 are held between the sheet feed roller 210 and the separation pad 211. As the sheet feed roller 210 is rotated, sheets 203 are separated into single sheets reliably and fed one by one. A sheet 203 thus fed passes between the sheet feed roller 210 and the pinch roller 213, and is transported to the registration rollers 214 after paper powder is removed from the sheet 203.

Being configured as a pair of rollers, the registration rollers 214 register the sheet 203 and then transport the sheet 203 to a transfer position between a photoreceptor 229 and a transfer roller 232 (both described later) where a toner image is to be transferred from the photoreceptor 229 to the sheet 203.

The image forming unit 205 is equipped with equipped with a scanner unit 219, the process cartridge 220, and a fixing member 221.

The scanner unit 219 occupies a top portion of the main body casing 202, and is equipped with a laser light source (not shown), a polygon mirror 222 that is driven rotationally, an fθ lens 223, a reflector 224, a lens 225, and a reflector 226. As indicated by a broken line, a laser beam emitted from the laser light source according to image data is deflected by the polygon mirror 222, passes through the fθ lens 223, is path-folded by the reflector 224, passes through the lens 225, is path-bent downward by the reflector 226, and is finally applied to the surface of a drum main body 234 of the photoreceptor 229 (described later) of the process cartridge 220.

Figure 18:
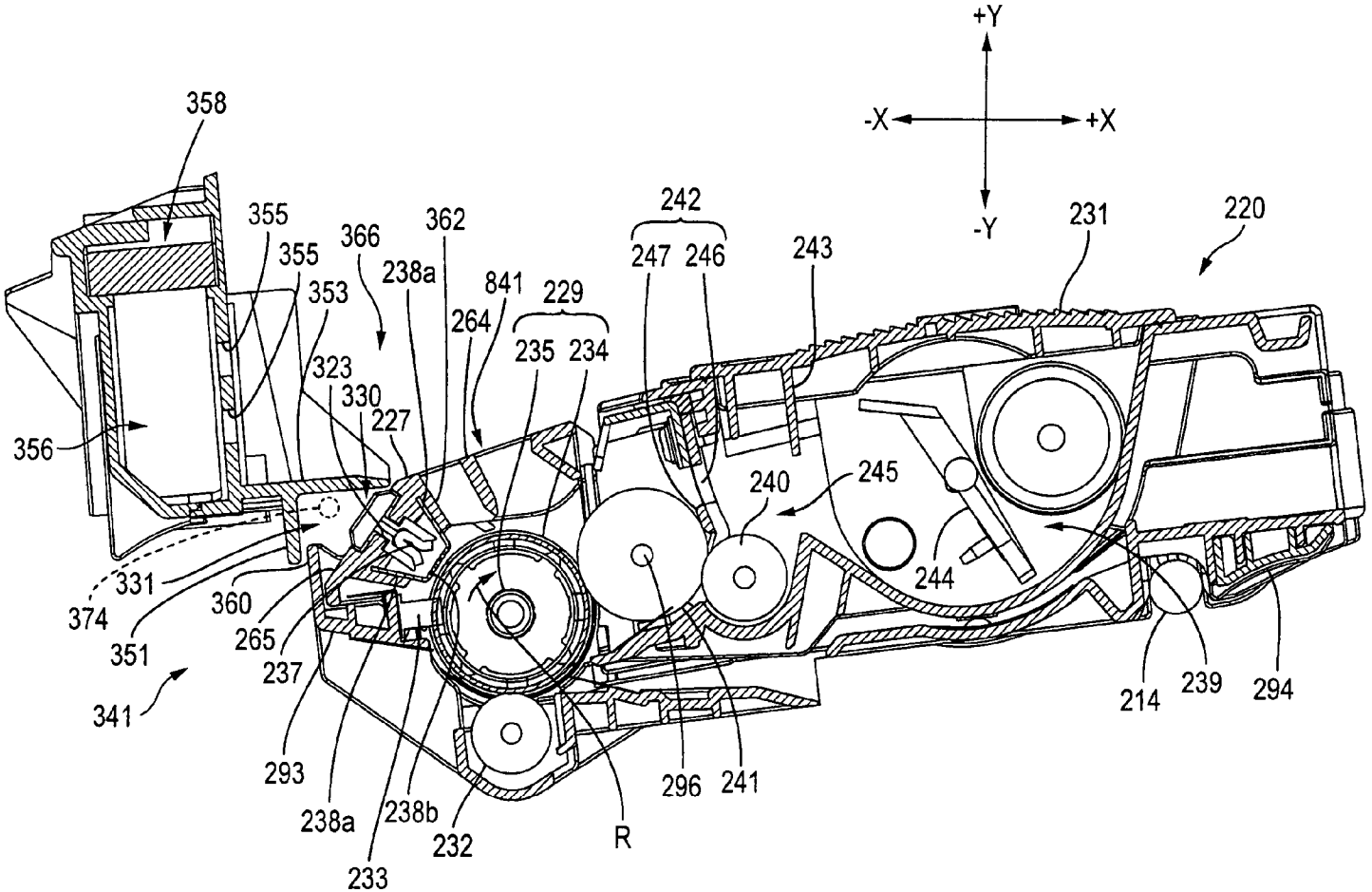
FIG. 18 is a sectional view taken along a cutting line XVIII-XVIII in FIG. 15.

The process cartridge 220 is attached to the main body casing 202 detachably so as to be disposed under the scanner unit 219. The process cartridge 220, as cases, a top frame 227 and a bottom frame 228 that is separate from and is combined with the top frame 227. As shown in FIG. 18, the process cartridge 220 is equipped with, in the cases, the photoreceptor 229, a scorotron charger 230 (hereinafter also referred to simply as "charger 230") as a charger, a development cartridge 231, the transfer roller 232, and a cleaning brush 233.

The photoreceptor drum 229 is equipped with the drum main body 234 that is cylindrical and whose outermost layer is a positively chargeable photoreceptor layer made of polycarbonate or the like and a metal drum shaft 235 that is the axis of the drum main body 234 and extends in its longitudinal direction. The drum shaft 235 is supported by the top frame 227 and the drum main body 234 is rotatably supported by the drum shaft 235. In this manner, the photoreceptor 229 is provided in the top frame 227 so as to be rotatable about the drum shaft 235.

The scorotron charger 230 is supported by the top frame 227 and is disposed at a top-rear position with respect to the photoreceptor 229 so as to be opposed to the photoreceptor 229 with a prescribed interval (contact with the photoreceptor 229 is avoided). The scorotron charger 230 is equipped with a discharge wire 237, facing electrodes 238*a* that extend in the axial direction of the photoreceptor 229 and are opposed to each other with a prescribed interval (see FIG. 18), and a grid electrode 238*b* (described later) that is disposed between the discharge wire 237 and the photoreceptor 229 and serves to control the amount of discharge from the discharge wire 237 to the photoreceptor 229. In the scorotron charger 230, a bias voltage is applied to the facing electrodes 238*a* and the grid electrode 238*b* and a high voltage is applied to the discharge wire 237, whereby corona discharge occurs from the discharge wire 237. As a result, the surface of the photoreceptor 229 can be charged positively in a uniform manner.

A wiper 236 (described later) for cleaning the discharge wire 237 is provided in the scorotron charger 230 so as to hold the discharge wire 237 from both sides.

The development cartridge 231 has a box shape that is open on the rear side, and is attached to the bottom frame 228 detachably. A toner accommodation room 239, a supply roller 240, a development roller 241, and a layer thickness limiting blade 242 are provided in the development cartridge 231.

The toner accommodation room 239 is a front internal space of the development cartridge 231 that is separated by a partition plate 243. A developer that is a positively chargeable, non-magnetic one-component toner is charged in the toner accommodation room 239. The toner is a polymeric toner obtained by copolymerizing, by suspension polymerization, polymerizable monomers that are, for example, a styrene monomer such as styrene and an acrylic monomer such as acrylic acid, alkyl (C1-C4) acrylate, or alkyl (C1-C4) methacrylate. Such a polymeric toner consists of generally spherical particles and is very high in flowability, and hence enables high-quality image formation.

The toner contains a colorant such as carbon black and wax, and an additive such as silica is added to increase the flowability. The average particle diameter of the toner is about 6 to 10 μm.

An agitator 244 is provided in the toner accommodation room 239. The toner in the toner accommodation room 239 is agitated by the agitator 244, and toner is discharged toward the supply roller 240 through an opening 245 that is formed under the partition plate 245 and allows passage in the front-rear direction.

The supply roller 240 is disposed behind the opening 245 and supported rotatably by the development cartridge 231. The supply roller 240 is configured in such a manner that a metal roller shaft is covered with a roller made of a conductive foamed material. The supply roller 240 is driven rotationally by motive power supplied from a motor (not shown).

The development roller 241 is disposed behind the supply roller 240, and is supported rotatably by the development cartridge 231 in such a manner that the development roller 241 and the supply roller 240 are in contact with each other and compress each other. The development roller 241 is opposed to and is in contact with the photoreceptor 229 in a state that the development cartridge 231 is attached to the bottom frame 228. The development roller 241 is configured in such a manner that a metal roller shaft 296 is covered with a roller made of a conductive rubber material. In a rear end portion of the development cartridge 231, both end portions of the roller shaft 296 project outward from the side surfaces of the development cartridge 231 in the width direction that is perpendicular to the front-rear direction (see FIGS. 15 and 16). The roller of the development roller 241 is configured in such a manner that the surface of a roller main body made of conductive urethane rubber or silicone rubber containing carbon fine particles etc. is covered with a coat layer made of urethane rubber or silicone rubber containing fluorine. During development, a development bias is applied to the development roller 241. The development roller 241 is rotationally driven in the same direction as the supply roller 240 by motive power supplied from a motor (not shown).

The layer thickness limiting blade 242 is configured in such a manner that a pressing portion 247 that is made of insulative silicone rubber and has a semicircular cross section is provided on a tip portion of a blade main body 246 made of a metal leaf spring member. The layer thickness limiting blade 242 is supported by the development cartridge 231 at a position above the development roller 241, and the pressing portion 247 is pressed against the development roller 241 by elastic force of the blade main body 246.

Toner that is discharged through the opening 245 is supplied to the development roller 241 by rotation of the supply roller 240. During that course, the toner is charged positively by friction between the supply roller 240 and the development roller 241. The toner that has been supplied onto the development roller 241 goes into the boundary between the pressing portion 247 of the layer thickness limiting blade 242 and the development roller 241 as the development roller 241 is rotated. And the toner comes to be carried by the development roller 241 as a thin layer having a constant thickness.

The transfer roller 232 is rotatably supported by the bottom frame 228. In a state that the top frame 227 and the bottom frame 228 are combined together, the transfer roller 232 is opposed to the photoreceptor 229 in the vertical direction and is in contact with the latter so that they can nip a sheet 203. The transfer roller 232 is configured in such a manner that a metal roller shaft 308 is covered with a roller made of a conductive rubber material. During a transfer, a transfer bias is applied to the transfer roller 232. The transfer roller 232 is rotationally driven in the direction opposite to the rotation direction of the photoreceptor 229 by motive power supplied from a motor (not shown).

The cleaning brush 233 is attached to the bottom frame 228, and is disposed behind the photoreceptor 229 so as to be opposed to and be in contact with the photoreceptor 229 in a state that the top frame 227 and the bottom frame 228 are combined together.

As the photoreceptor 229 is rotated, its surface is charged positively in a uniform manner by the scorotron charger 230 and is then scanned at high speed with (i.e., exposed to) a laser beam coming from the scanner unit 219, whereby an electrostatic latent image corresponding to an image to be formed on a sheet 203 is formed.

Then, as the development roller 241 is rotated, toner that is carried by the development roller 241 and charged positively is supplied to the exposed portions (where the potential has been lowered by the exposure to the laser beam) of the surface of the photoreceptor 229 that was charged positively in a uniform manner. As a result, the electrostatic latent image on the photoreceptor 229 is visualized and a toner image is formed on the surface of the photoreceptor 229 by inverted development.

Then, as shown in FIG. 13, the toner image formed on the surface of the photoreceptor 229 is transferred to a sheet 203 because of the presence of a transfer bias applied to the transfer roller 232 when the sheet 203 that has been transported by the registration rollers 214 passes the transfer position between the photoreceptor 229 and the transfer roller 232. The sheet 203 to which the toner image has been transferred is transported to the fixing member 221.

Transfer residual toner that remains on the photoreceptor 229 after the transfer is collected by the development roller 241. Paper powder that has come from the sheet 203 and is stuck to the photoreceptor 229 after the transfer is collected by the cleaning brush 233.

The fixing member 221 is disposed behind the process cartridge 220 and is equipped with a fixing member frame 248. A heating roller 249 and a pressing roller 250 are provided in the fixing member frame 248.

The heating roller 249 is equipped with a metal pipe whose surface is coated with a fluororesin and a halogen lamp for heating that is provided in the metal pipe. The heating roller 249 is rotationally driven by motive power supplied from a motor (not shown).

The pressing roller 250 is disposed below the heating roller 249, and is opposed to the heating roller 249 so as to be pressed against it. The pressing roller 250 is configured in such a manner that a metal roller shaft is covered with a roller made of a rubber material. The pressing roller 250 is rotated so as to follow the rotation of the heating roller 249.

In the fixing member 221, the toner that has been transferred to the sheet 203 at the transfer position is fixed thermally when the sheet 203 passes between the heating roller 249 and the pressing roller 250. The sheet 203 on which the toner has been fixed is transported to a sheet ejection path 251 that extends upward toward the top surface of the main body casing 202. The sheet 203 that has been transported to the sheet ejection path 251 is ejected onto a sheet ejection tray 253 that is part of the top surface of the main body casing 202 by a sheet ejection roller 252 that is disposed above the sheet ejection path 251.

2. Configuration of Process Cartridge

Frame Structure

As shown in FIG. 15, the top frame 227 of the process cartridge 220 is provided with a left side wall 254, a right side wall 255, and a top wall 256 that are integral with each other.

As shown in FIGS. 15 and 16, the left side wall 254 is provided with a bottom-left side plate 257 that is disposed on one side of the drum main body 234 in the width direction (in the axial direction of the photoreceptor 229; this one side in the width direction will be hereinafter referred to as "left side" and the other side in the width direction as "right side"), an extended plate 258 that extends rightward from the top end of the bottom-left side plate 257 and covers a drum gear 281 (described later) from above, and a top-left side plate 259 that extends upward from the right end of the extended plate 258.

A bearing member 266 that supports the drum shaft 235 is fitted in the bottom-left side plate 257, and the drum shaft 235 is inserted in a hole (not shown) that is formed through the bearing member 266.

As shown in FIG. 16, a wire terminal 261 for supplying electricity to the discharge wire 237 of the scorotron charger 230 and a counter electrode terminal 262 for supplying electricity to the facing electrodes 238*a* of the scorotron charger 230 are formed in the top-left side plate 259 at a front position and a rear position, respectively. The top end surface of the top-left side plate 259 is formed by a horizontal portion that extends approximately horizontally in the front-rear direction and a slant portion that extends obliquely downward from the rear end of the horizontal portion.

As shown in FIG. 15, the right side wall 255 assumes a flat plate shape and is disposed on the right side of the drum main body 234. The top end surface of the right side wall 255, which is shaped so as to correspond to the top end surface of the top-left side plate 259, is formed by a horizontal portion that extends approximately horizontally in the front-rear direction and is in the same plane as the horizontal portion of the top end surface of the top-left side plate 259 and a slant portion that extends obliquely downward from the rear end of the horizontal portion and is in the same plane as the slant portion of the top end surface of the top-left side plate 259. A bearing member 267 is fitted in the right side plate 255, and the drum shaft 235 is inserted in a hole (not shown) that is formed through the bearing member 267.

As described above, the drum shaft 235 of the photoreceptor 229 is supported via the bearing members 266 and 267 which are located on the left side and the right side, respectively. Two end portions of the drum shaft 235 project outward from the bearing members 266 and 267 in the right-left direction and are inserted in respective stoppers 278. The stoppers 78 prevents the drum shaft 235 from falling off. A ground (not shown) that is provided in the main body casing 202 to ground the drum shaft 235 is connected to the end portion of the drum shaft 235 that projects from the left bearing member 266 in a state that the process cartridge 220 is attached to the main body casing 202.

Between the bearing members 266 and 267, the drum shaft 235 supports the drum main body 234 in such a manner that the latter is rotatable relatively to the former. A gear member (not shown) is attached to the drum main body 234 at a left end position in the axial direction. Motive power is supplied from a main motor (not shown) to the gear member, whereby the drum main body 234 (see FIGS. 13 and 14) is rotated.

As shown in FIG. 15, the top wall 256 is provided with a top horizontal portion 264 and a top slant portion 265. The top horizontal portion 264 bridges the horizontal portion of the top end surface of the top-left side plate 259 and the horizontal portion of the top end surface of the right side wall 255.

The top horizontal portion 264 is located over the photoreceptor 229 (see FIG. 18). The top horizontal portion 264 is formed with a laser beam input window 841 that is generally rectangular in a plan view. The laser beam input window 841 is for input of a laser beam that comes from the scanner unit 219 and serves for a high-speed scan. Further, plural air passages 362 (described later) are formed adjacent to the laser beam input window 841.

The top slant portion 265 bridges the slant portion of the top end surface of the top-left side plate 259 and the slant portion of the top end surface of the right side wall 255. The top slant portion 265 is separated from the top horizontal portion 264 by a prescribed interval in the front-rear direction and is located at a top-rear position with respect to the photoreceptor 229. The top slant portion 265 is provided with the scorotron charger 230 (described later; see FIG. 18). As shown in FIG. 17, the discharge wire 237 is stretched between the top-left side plate 259 and the right side wall 255 approximately parallel with the top slant portion 265. The facing electrodes 238*a* and the grid electrode 238*b* extend approximately parallel with the top slant portion 265 and bridge the top-left side plate 259 and the right side wall 255.

As shown in FIG. 15, the bottom frame 228 is provided with a pair of side walls 292. As shown in FIG. 16, the left side wall 292 is formed with an opening 311 through which a transfer electrode 313 is exposed. The left side wall 292 is provided with a cleaning electrode 304 for applying a cleaning bias to the cleaning brush 233.

Structure of Charger

Next, the scorotron charger 230 will be described in detail.

Figure 19:
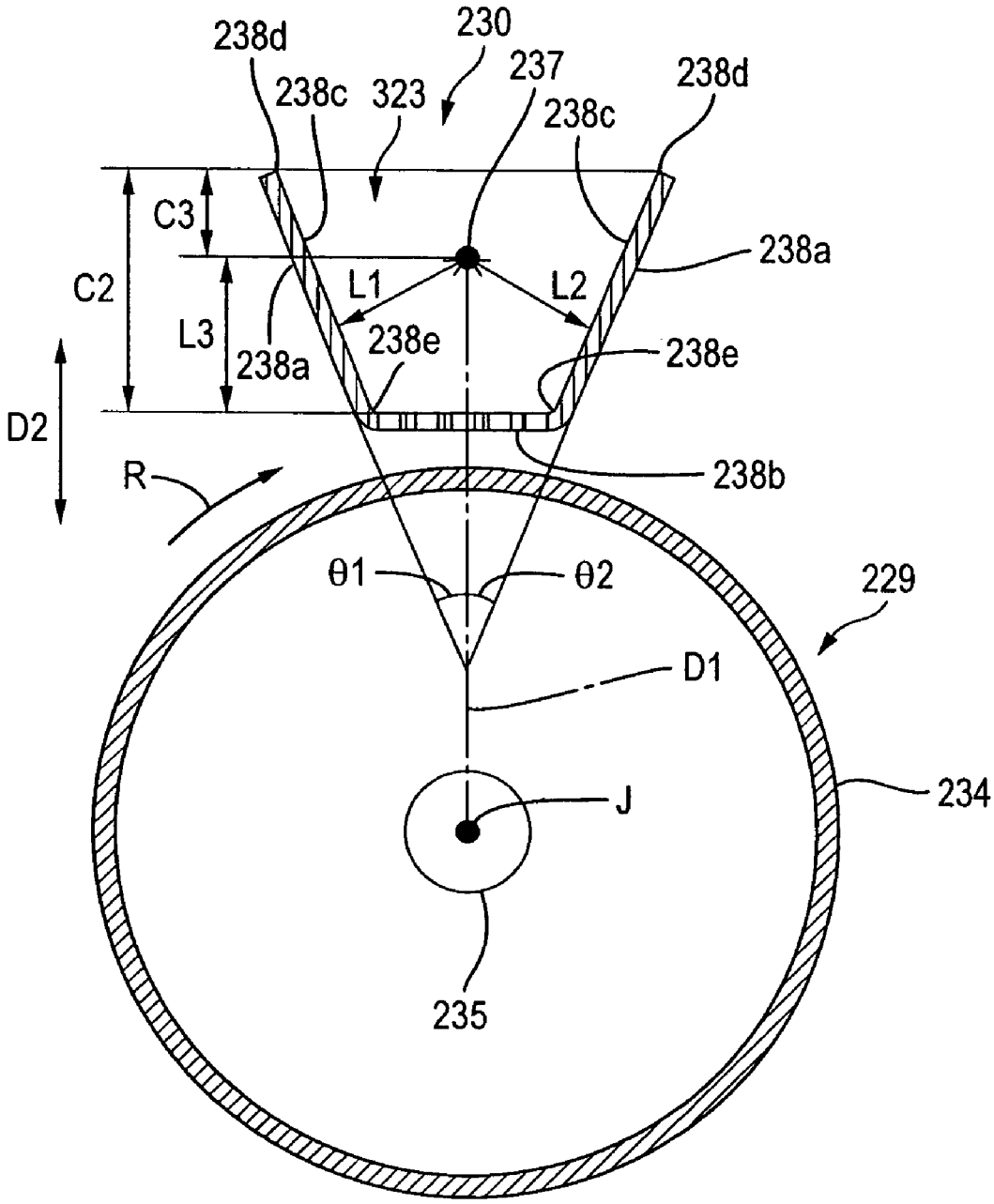
FIG. 19 is an explanatory diagram showing a relationship between a charger and a photoreceptor.
Figure 20:
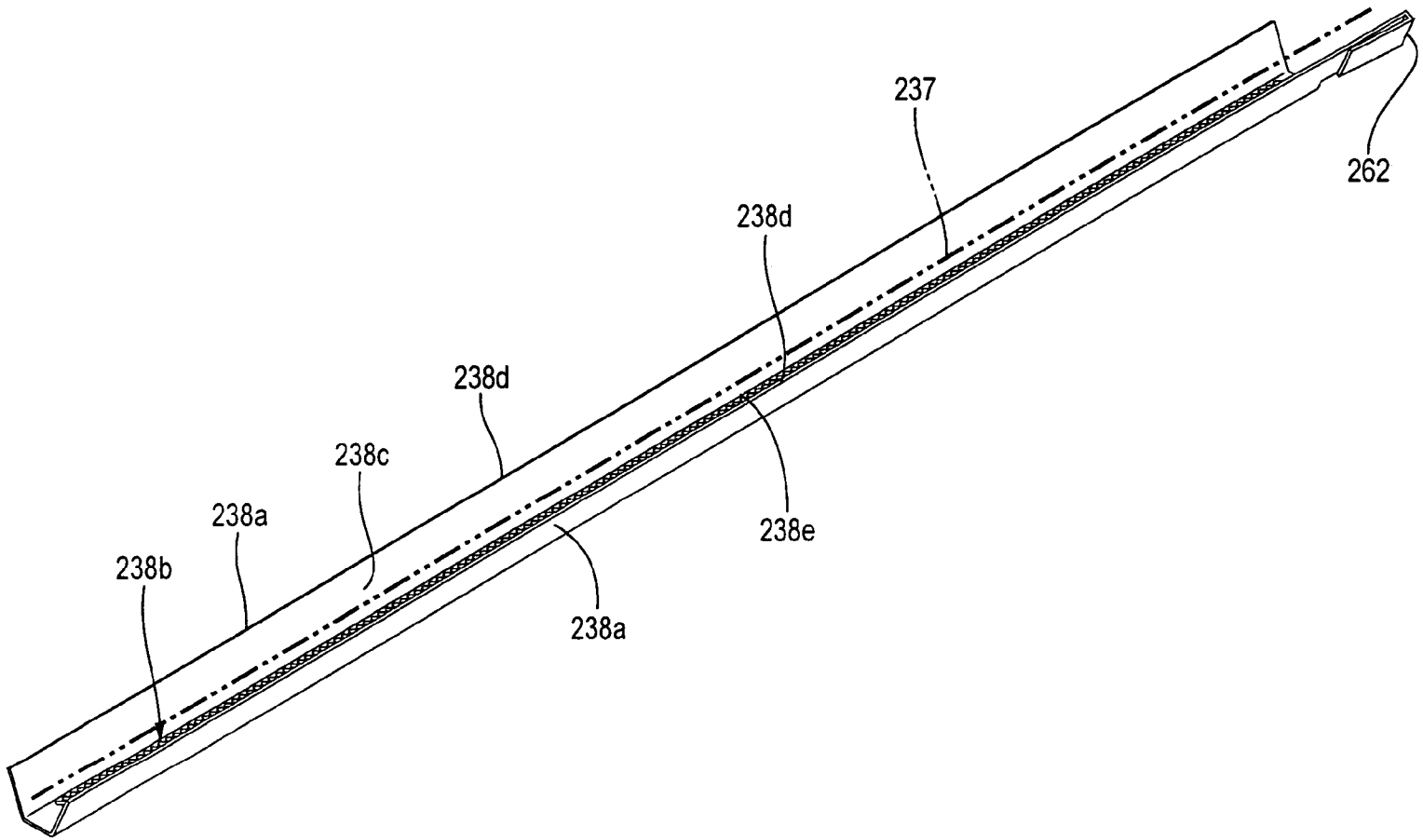
FIG. 20 is a perspective view illustrating facing electrodes.
Figure 21:
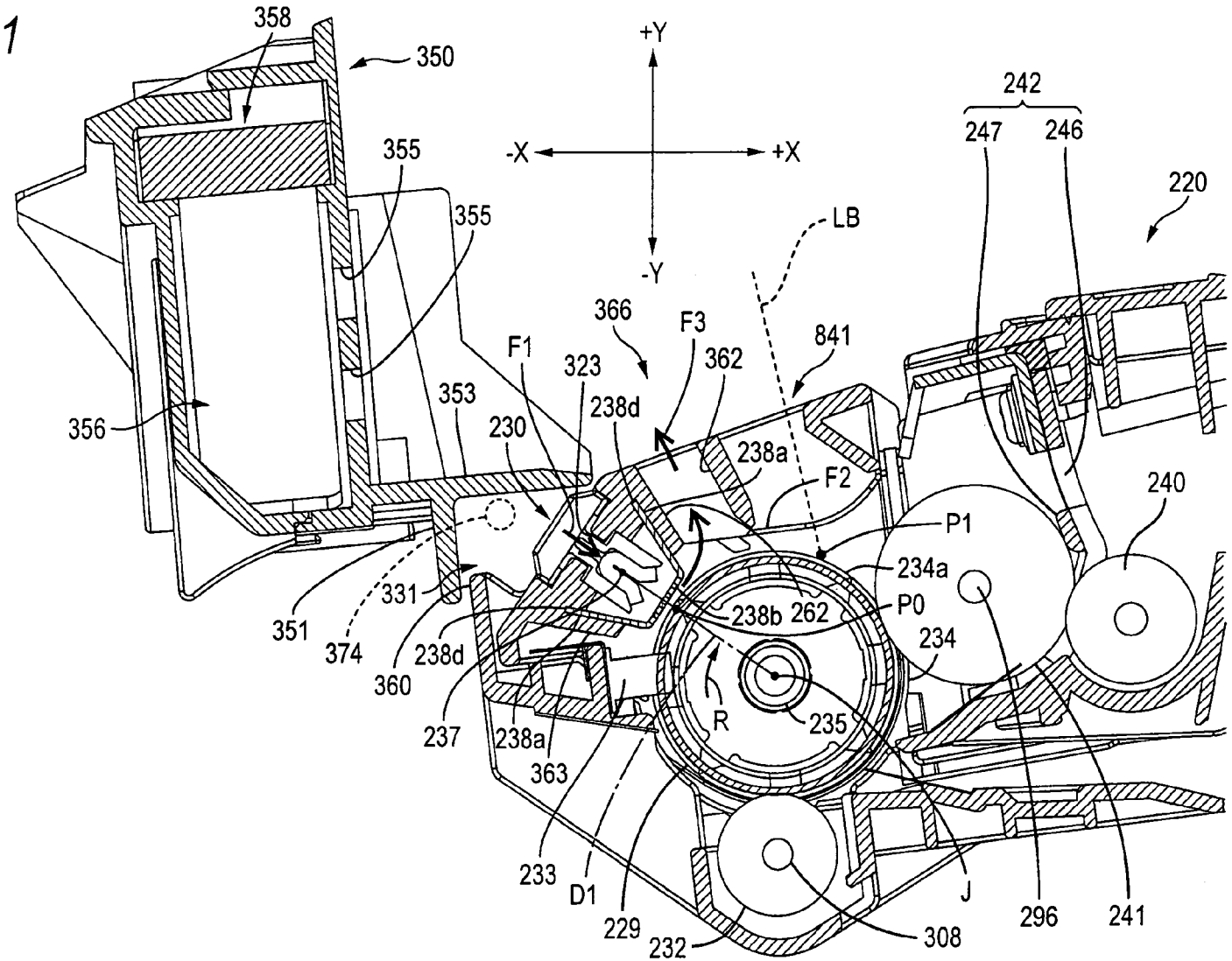
FIG. 21 is an enlarged explanatory view of part of FIG. 18.

FIG. 18 is a sectional view taken along a cutting line XVIII-XVIII in FIG. 15 and a corresponding sectional view of a duct. FIG. 19 is an explanatory diagram showing a relationship between the charger 230 and the photoreceptor 229. FIG. 20 is a perspective view illustrating the facing electrodes 238*a* and the grid electrode 238*b*. FIG. 21 is an enlarged explanatory view of part of FIG. 18. In the following description of the charger 230 according to the embodiment, in the opposed direction D2 (see FIG. 19) in which the discharge wire 237 and the photoreceptor 229 are opposed to each other, it is assumed that the photoreceptor 229 is located "under" the discharge wire 237 and 15 the side opposite to the photoreceptor 229 is located "over" the discharge wire 237.

As shown in FIG. 18, the scorotron charger 230 is opposed to the photoreceptor 229 and is equipped with the discharge wire 237 as a discharge electrode, the facing electrodes 238*a* that are disposed so as to be distant from the discharge wire 237, and the grid electrode 238*b*. The photoreceptor 229 that is rotating is charged by causing corona discharge by the discharge wire 237, the facing electrodes 238*a*, and the grid electrode 238*b*.

The facing electrodes 238*a* are a pair of walls that are arranged on both sides of the discharge wire 237 in the rotation direction R of the photoreceptor 229 (i.e., the discharge wire 237 is interposed between the walls). As shown in FIG. 19, the facing electrodes 238*a* are shaped in such a manner that their interval decreases gradually as the position goes downward in the opposed direction D2 starting from a position located over a discharge portion (in the embodiment, the discharge portion is a portion in a discharge wire 237 stretched region C1 (see FIG. 17)) of the discharge wire 237. The opposed direction D2 is the direction that connects the axis of the discharge wire 237 in the stretched region C1 (see FIG. 17) and the rotation center J of the photoreceptor 229 (i.e., the axis of the drum shaft 235) so as to make a right angle with each of those.

As shown in FIG. 19, the top ends 238*d* of the facing electrodes 238*a* are approximately at the same level in the opposed direction D2 and their bottom ends 238*e* are also approximately at the same level in the opposed direction D2. The interval between the facing electrodes 238*a* decreases gradually as the position goes down in the opposed direction D2 from the top level corresponding to the top ends 238*d* to the bottom level corresponding to the bottom ends 238*e*. That is, an interval decreasing region C2 where the interval between the facing electrodes 238*a* decreases gradually extends in the opposed direction D2 from the top end and the bottom end of the region where the facing electrodes 238*a* are disposed to face with each other.

As shown in FIGS. 19 and 20, inner surfaces 238*c*, facing the discharge wire 237, of the respective facing electrodes 238*a* are flat surfaces in the entire interval decreasing region C2 where the interval between the facing electrodes 238*a* decreases gradually. Each of the facing electrodes 238*a* is bent from the plate-like grid electrode 238*b* and is generally flat. As shown in FIG. 19, the bending positions of the facing electrodes 238*a* are at the same level as the bottom end of the interval decreasing region C2.

As shown in FIG. 19, angles θ1 and θ2 that are formed by a plane D1 connecting the discharge wire 237 and the rotation center J of the photoreceptor 229 and the inner surfaces 238*c*, facing the discharge wire 237, of the facing electrodes 238*a* are set identical. The plane D1 is a plane that connects the axis of the discharge wire 237 in the stretched region C1 (see FIG. 17) and the rotation center J (the axis of the drum shaft 235).

FIG. 20 shows a positional relationship between the discharge wire 237 (indicated by a two-dot chain line) and the facing electrodes 238*a*. In the embodiment, the charger 230 is configured in such a manner that the discharge wire 237 is parallel with the longitudinal directions of the facing electrodes 238*a* and the distances L1 and L2 between the discharge wire 237 and the respective facing electrodes 238*a* are identical. In the charger 230, the distances L1 and L2 are set equal to the distance L3 between the discharge wire 237 and the grid electrode 238*b*. The distance L1 is the length of the perpendicular drawn from the discharge wire 237 to the one counter electrode 238*a* located upstream of (in FIG. 19, on the left side of) the discharge wire 237 in the rotation direction of the photoreceptor 229 in a cross section taken perpendicularly to the axial direction of the photoreceptor 229 (i.e., in a cutting plane perpendicular to the axial direction of the photoreceptor 229). The distance L2 is the length of the perpendicular drawn from the discharge wire 237 to the other counter electrode 238*a* located downstream of (in FIG. 19, on the right side of) the discharge wire 237 in the rotation direction of the photoreceptor 229 in a cross section taken perpendicularly to the axial direction of the photoreceptor 229 (i.e., in a cutting plane perpendicular to the axial direction of the photoreceptor 229). The distance L3 is the length of the perpendicular drawn from the discharge wire 237 to the grid electrode 238*b* in a cross section taken perpendicularly to the axial direction of the photoreceptor 229 (i.e., in a cutting plane perpendicular to the axial direction of the photoreceptor 229).

As shown in FIGS. 19 and 21, an opening 323 through which to introduce air from outside the facing electrodes 238*a* is formed between the top ends 238*d* of the facing electrodes 238*a*. Slits 325 (see FIG. 17) through which to introduce air to the opening 323 are formed through the top frame 227 above the opening 323 between the top ends 238*d*. On the other hand, plural slits are formed through a prescribed portion of the grid electrode 238*b* that extends between the bottom ends 238*e*.

Figure 22:
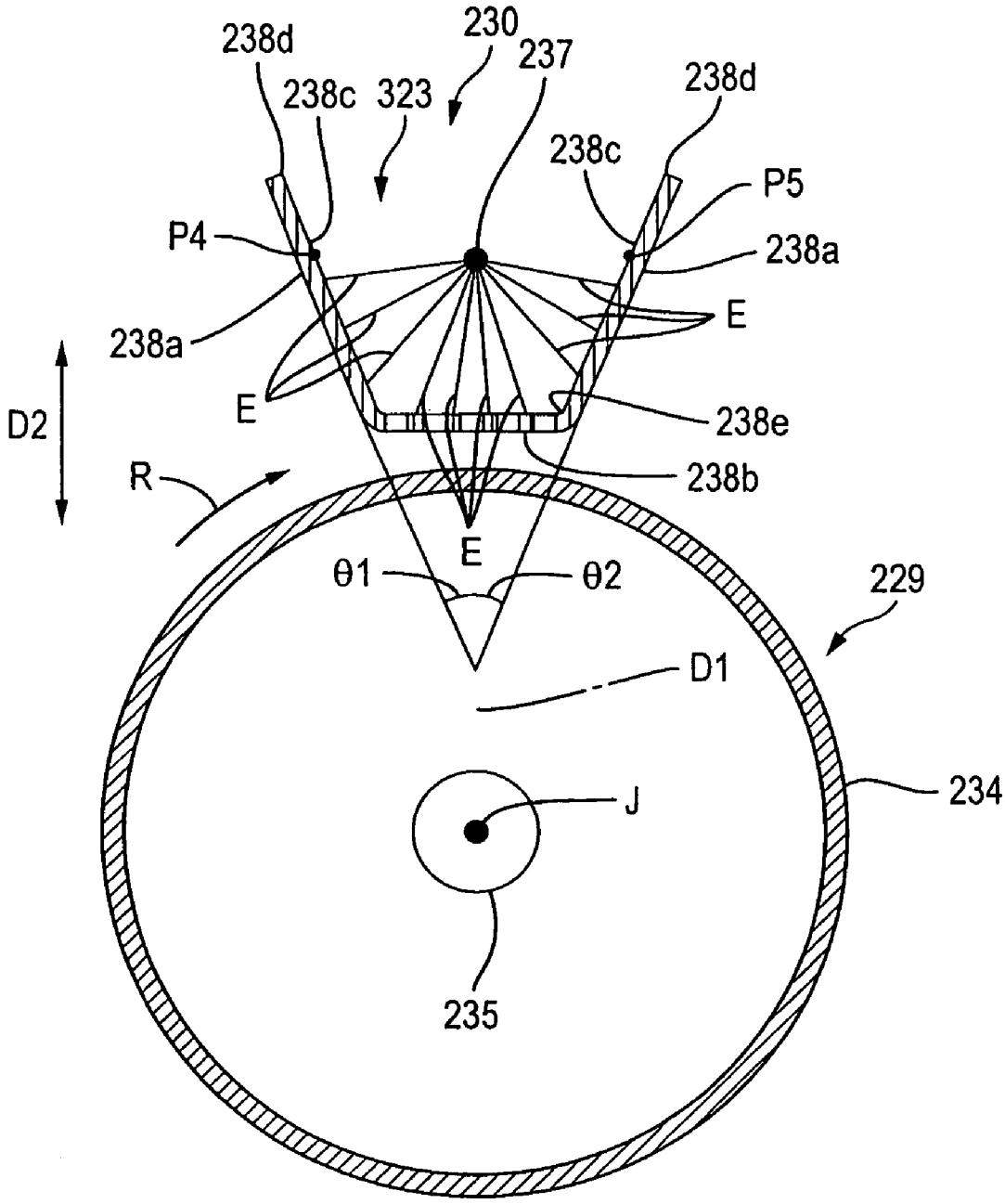
FIG. 22 is an explanatory diagram showing discharge of the charger.

As described above, the interval between the facing electrodes 238*a* decreases gradually as the position goes closer to the photoreceptor 229, whereby discharge tends to be concentrated on the photoreceptor 229 side. FIG. 22 is an explanatory diagram schematically showing such concentration of discharge, that is, schematically showing, using electric field lines E, an electric field that is formed by the charger 230 during discharge. In the structure according to the embodiment, as shown in FIG. 22, the interval between the facing electrodes 238*a* decreases gradually as the position goes down starting from the position over the discharge portion of the discharge wire 237. Therefore, the positions on the facing electrodes 238*a* having the shortest distance from the discharge wire 237 (i.e., the feet of the perpendiculars (L1 and L2 in FIG. 19) drawn from the discharge wire 237 to the respective facing electrodes 238*a* in the cross section taken perpendicularly to the axial direction of the photoreceptor 229) are closer to the photoreceptor 229 than the positions right beside the discharge wire 237 (i.e., the positions P4 and P5 right at the sides, the side direction being the direction perpendicular to the opposed direction D2 in FIG. 22) are. As a result, as shown in FIG. 22, the electric field lines E of an electric field that develops between the discharge wire 237 and the facing electrodes 238*a* during discharge are dense on the photoreceptor 229 side. On the other hand, since the charger 230 is open above the discharge wire 237 and has the grind electrode 238*b* at the bottom, the electric field that develops during discharge is such that no electric field lines are formed above the discharge wire 237 and the density of electric field lines is high near the grid electrode 238*b* that is located under the discharge wire 237. With such an electric field, discharge is more apt to occur at the positions on the facing electrodes 238*a* that are closer to the photoreceptor 229 than the positions P4 and P5 right beside the discharge wire 237 are.

As shown in FIG. 21, air passages 362 for guiding, along a path that is different from the flow passage extending between the opening 323 and the photoreceptor 229, air that has flown from the opening 323 to the photoreceptor 229 is provided outside the counter electrode 238*a* that is located downstream of the discharge wire 237 in the rotation direction of the photoreceptor 229. The air passages 362 will be described later.

3. Structure of Air Passages

Next, air passages will be described.

Figure 23:
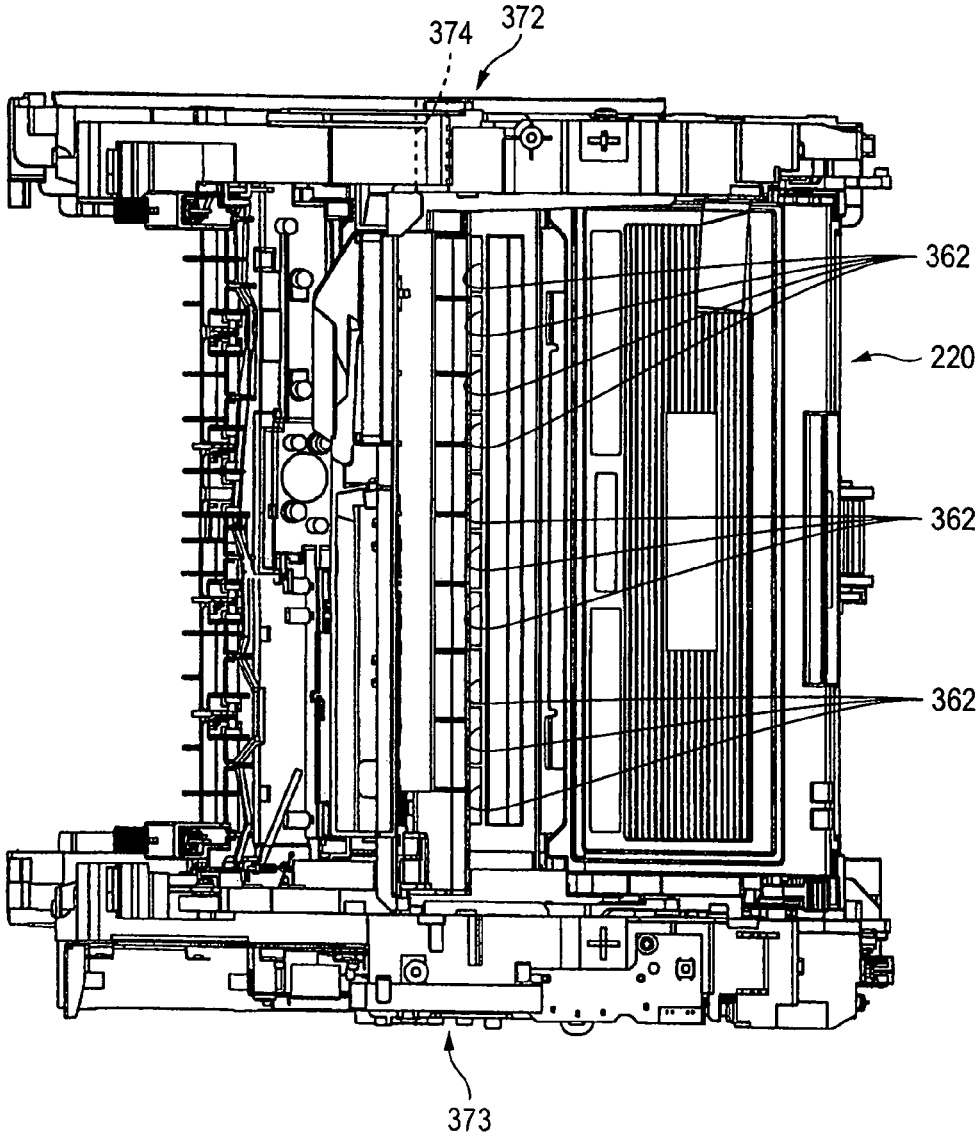
FIG. 23 is a plan view showing the arrangement of the process cartridge, a duct, and both frames.
Figure 24:
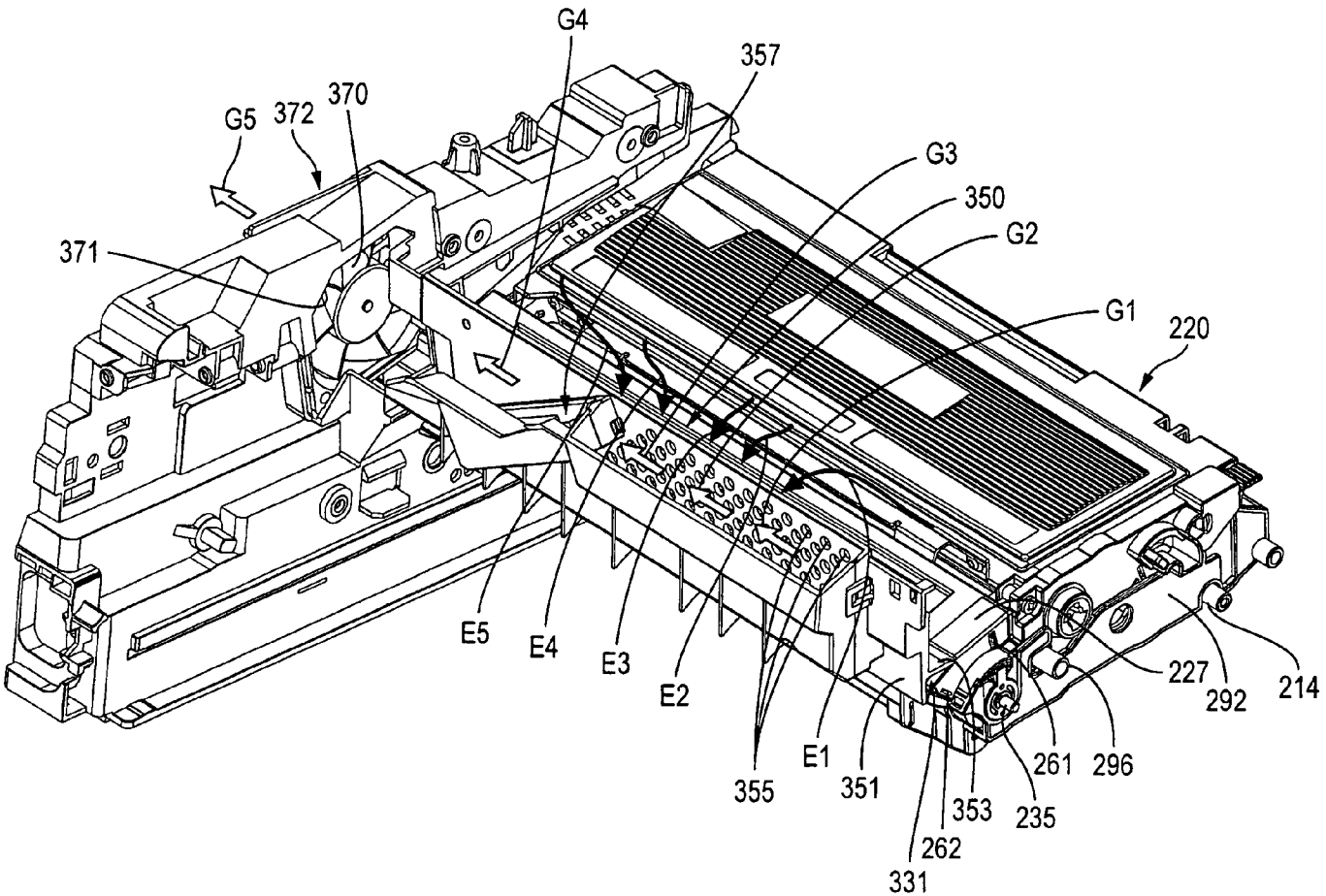
FIG. 24 is a perspective view showing the arrangement of the process cartridge, the duct, and one frame.
Figure 25:
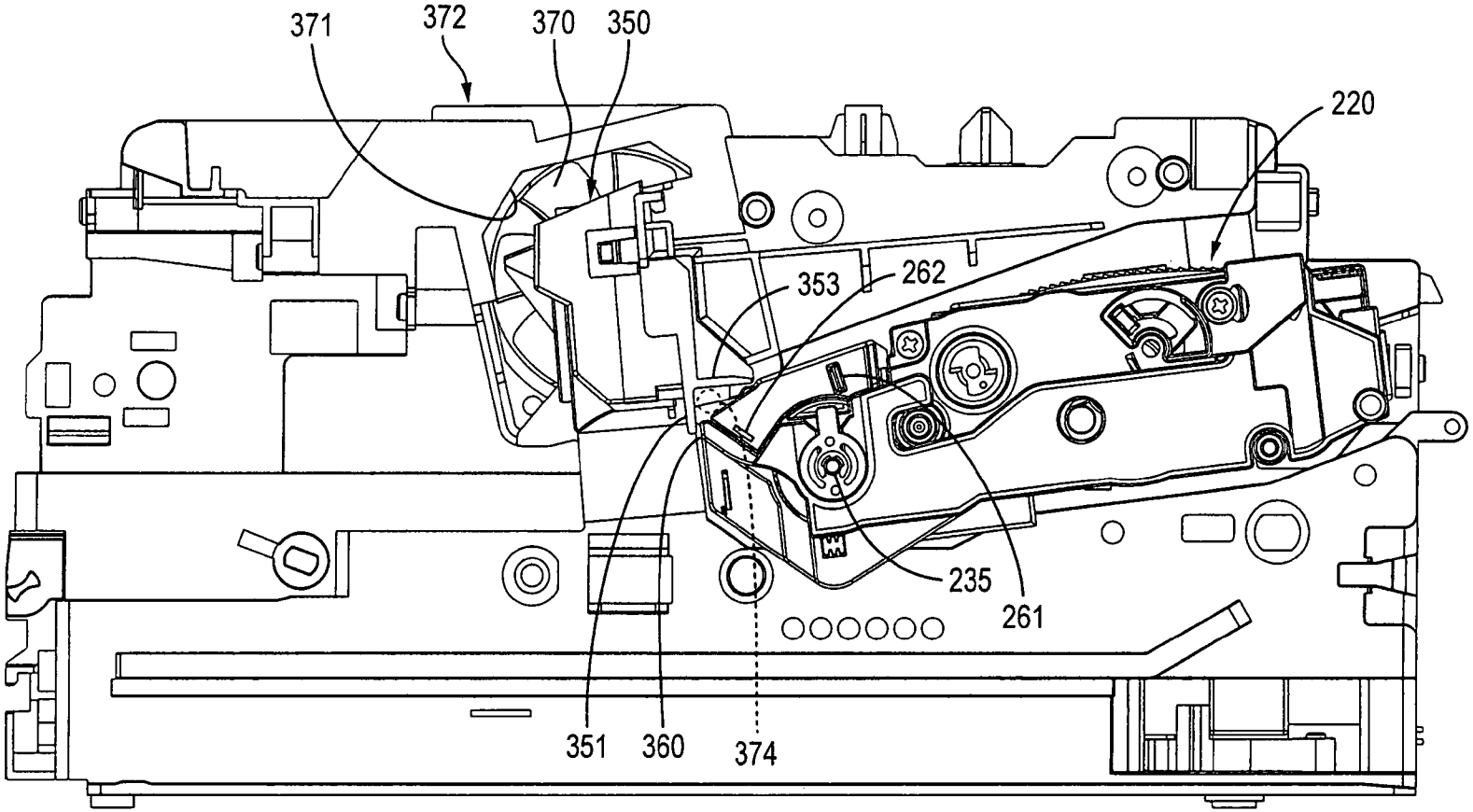
FIG. 25 is a side view corresponding to FIG. 24 and showing the arrangement of the process cartridge, the duct, and the one frame.

FIG. 23 is a plan view showing the arrangement of the process cartridge 220, a duct 350, and both frames 372 and 373. FIG. 24 is a perspective view showing the arrangement of the process cartridge 220, the duct 350, and the one frame 372. FIG. 25 is a side view corresponding to FIG. 24.

As shown in FIGS. 18 and 21, a charger-side space 331 is formed around the charger 230. As shown in FIGS. 13 and 14, the charger-side space 331 is a space formed by the inner surface of a cartridge accommodation portion 330 that accommodates the process cartridge 220 and the outer surface of the charger 230. On the other hand, a fixing member-side space 341 is formed behind the cartridge accommodation portion 330. The fixing member-side space 341 is a space that is formed around the fixing member 221 by a fixing member accommodation portion 340 that communicates with the cartridge accommodation portion 330 via an opening 335. The fixing member accommodation portion 340 is formed by portions that surround the fixing member 221 (i.e., a bottom portion 340*a* (see FIG. 13), a ceiling portion 340*b* (see FIG. 14), and the side frames 372 and 373 (see FIG. 23)).

As shown in FIG. 21, a closing rib 360 for increasing the closed area of the opening 335 is provided on an outer surface of the process cartridge 220 that is closer to the fixing member 221 (see FIG. 13) than the charger 230 is. The closing rib 360 separates the charger-side space 331 and the fixing member-side space 341 from each other and functions to suppress inflow of air into the charger-side space 331 from the fixing member-side space 341. As shown in FIG. 13, the opening 335 is closed by the outer surface of the process cartridge 220 and the presence of the closing rib 360 increases the closed area of the opening 335. As shown in FIG. 15, the closing rib 360 is formed parallel with the longitudinal direction of the discharge wire 237 (parallel with the axial direction of the photoreceptor 229, that is, in the Z-axis direction in FIG. 15). The closing rib 360 is provided so as to cover, in the longitudinal direction (Z-axis direction), at least the entire stretched region C1 where the discharge wire 237 is stretched.

As shown in FIG. 17, the discharge wire 237 is stretched at proper tension in such a manner that its one end is connected to the top frame 227 and the other end is pulled by a torsion coil spring 121 as an urging member. The top frame 227 is formed with a pair of support walls 227*a* and 227*b* that support the discharge wire 237. The positions where the pair of support walls 227*a* and 227*b* support the discharge wire 237 are support positions P2 and P3, and the region extending in the longitudinal direction between the support positions P2 and P3 is the stretched region C1 (also see FIG. 15).

In the laser printer 201, as shown in FIG. 23, the wall-shaped frames 372 and 373 are disposed on both sides in the longitudinal direction of the discharge wire 237 so as to be opposed to each other. The charger-side space 331 shown in FIG. 21 communicates with the outside of the laser printer 201 via an air passage hole 374 that is formed through the frame 372. The charger-side space 331 is a long space that is surrounded in four directions (top, bottom, right, and left) by the opening rib 351, a partition 353 (described later), the closing rib 360, and the charger 230 and that extends parallel with the longitudinal direction of the discharge wire 237 (i.e., in the Z-axis direction (see FIG. 15)). And the charger-side space 331 is surrounded on both sides by the frames 372 and 373. The air passage hole 374 (see FIGS. 18 and 21) is formed through the frame 372 that is disposed on the one side.

As shown in FIGS. 24 and 25, a fan 370 for sucking air from the charger-side space 331 and generating an air flow that is directed from the charger 230 to the photoreceptor 229 is provided in the frame 372 at a position that is separated from the air passage hole 374 by a prescribed distance. The fan 370 communicates with the charger-side space 331 via the duct 350, the air passages 362, and the charger 230, and functions to suck air from the charger-side space 331 and generate an air flow that is directed from the charger 230 to the photoreceptor 229.

As shown in FIG. 21, the air passages 362 for guiding an air flow that has flown from the charger 230 to the photoreceptor 229 in such a direction that it goes away from the photoreceptor 229 are provided between a charging position P0 where the charger 230 is opposed to the photoreceptor 229 and an exposure position P1 of the exposing unit (i.e., a laser beam LB application position) on the outer circumferential surface 234*a* of the drum main body 234 of the photoreceptor 229. The charger 230 is provided with a pair of support walls 363 and 364 that extend parallel with the longitudinal direction of the discharge wire 237 and are disposed to face with each other. Air flows through the inside of the support walls 363 and 364 from the charger-side space 331 to the photoreceptor 229, U-turns near the outer circumferential surface 234*a*, and is then guided out through the air passages 362. The one of the facing electrodes 238*a* is supported by the one surface of the support wall 164 and the other surface serves as the inner surfaces of the air passages 362. In FIG. 21, an air flow coming from the charger-side space 331 is indicated conceptually by arrows F1, F2, and F3. With the thus-formed air passages 362, ions generated by corona discharge are less prone to hit exposed portions of the photoreceptor 229 whereas ions are supplied to the photoreceptor 229 smoothly, which realizes a configuration that re-charging of the exposed portions can be prevented. This makes it possible to effectively prevent image quality deterioration due to such re-charging.

Air that is guided out through the air passages 362 is sent to a space 366 that is located outside the process cartridge 220 and separated from the charger-side space 331, and is then ejected to the outside via the duct 350 and an ejector hole 371 where the fan 370 is provided. The charger-side space 331 and the space 366 are separated from each other by the partition 353 that extends parallel with the longitudinal direction and closes the charger-side space 331 from above. The partition 353 prevents an air flow that has flown from the air passages 362 to the space 366 from flowing into the charger-side space 331 again.

As shown in FIGS. 24 and 25, the one frame 372 of the laser printer 201 is formed with the ejection hole 371 through which air that has flown from the charger-side space 331 to the photoreceptor 229 is ejected to the outside of the laser printer 201. As shown in FIG. 21, the duct 350 is configured as a flow passage for taking, through plural intermediary holes 355, air that has been guided out through the air passages 362 and exists in the space 366 located over the partition 353 and for guiding the air to the ejection hole 371 (see FIG. 24).

The air passage hole 374 and the ejection hole 371 are formed in only the frame 372 of the frames 372 and 373 that are opposed to each other. The intermediary holes 355 of the duct 350 are formed at a position in the longitudinal direction that is closer to the frame 373 in which the air passage hole 374 and the ejection hole 371 are not formed so that air that has flown from the charger-side space 331 to the photoreceptor 229 goes through the intermediary holes 355 (see FIG. 24). As shown in FIG. 21, having an internal flow passage 356, the duct 350 is configured so as to guide air that has entered through the air passage hole 374 and passed through the intermediary holes 355 to the ejection hole 371 along a path that does not pass the charger-side space 331. As shown in FIG. 24, an ozone filter 357 is disposed in the duct 350 between the intermediary holes 355 and the ejection hole 371. The ozone filter 357 is disposed in such a manner that a filter outer surface is inclined from the air flow direction (in the embodiment, from the longitudinal direction of the discharge wire 237), and functions to remove ozone that is generated by corona discharge. In FIG. 24, a top cover 358 (see FIG. 21) is omitted to show the internal structure of the duct 350. In FIG. 24, flows of air that is taken from the space 366 (see FIG. 21) through the plural intermediary holes 355 are indicated conceptually by arrows E1-E5 and flows of air that is ejected through the ejection hole 371 past the ozone filter 357 after being taken through the plural intermediary holes 355 are indicated by arrows G1-G5.

As shown in FIGS. 23 and 24, in the laser printer 201, the driving mechanism for driving the photoreceptor 229 (see FIG. 13 etc.) is disposed on the side (frame 373 side (see FIG. 23)) where the air passage hole 374 and the ejection hole 371 are not provided. In the process cartridge 220, the wire terminal 261 for supplying electric power to the discharge wire 237 and the counter electrode terminal 262 are provided on the frame 373 side (also see FIG. 21). A high-voltage power circuit board (not shown) capable of applying high voltages is attached to the frame 373 so as to be electrically connected to the wire terminal 261 and the counter electrode terminal 262. The high-voltage power circuit board is provided with a power circuit (not shown) capable of applying high voltages, and plural electricity supply members (not shown) that are conductive and elastic wires electrically connected to the power circuit are provided on the inner surface of the frame 373. These electricity supply members contact the wire terminal 261 and the counter electrode terminal 262, respectively, when the process cartridge 220 is attached. Voltages of the power circuit are applied via the individual electricity supply members. As described above, the above-mentioned motor, high-voltage power circuit board, etc. are provided and various related components are arranged at a high density on the frame 373 side. Therefore, it is difficult to provide the above-mentioned air passage hole 374 and ejection hole 371 on the frame 373 side. However, the configuration of the embodiment enables an efficient arrangement because the air passage hole 374 and the ejection hole 371 are concentrated on the frame 372 side and the above-mentioned driving mechanism and supply mechanism are provided on the opposite side, that is, on the frame 373 side.

In the invention, as shown in FIG. 19, discharge can be concentrated in a region closer to the photoreceptor 229 side in the opposed direction D2 and ions generated by discharge can efficiently be supplied to the photoreceptor 229. Since the interval between the facing electrodes 238*a* decreases gradually as the position goes closer to the photoreceptor 229, the installation space of the facing electrodes 238*a* can be reduced particularly in the vicinity of the photoreceptor 229, which makes it easier to accommodate miniaturization of the photoreceptor 229. In particular, since the interval between the facing electrodes 238*a* decreases gradually as the position goes down starting from the position over the discharge portion of the discharge wire 237, the effect of reducing the installation space of the facing electrodes 238*a* is great, which makes it even easier to accommodate miniaturization of the photoreceptor 229.

As shown in FIGS. 19 and 20, the inner surfaces 238*c* of both facing electrodes 238*a* are flat surfaces in the entire interval decreasing region C2 where the interval between the facing electrodes 238*a* decreases gradually, no projections or recesses exist and hence discharge is not prone to be concentrated at a particular location in the interval decreasing region C2. Stable discharge is thus enabled.

Since the interval between the facing electrodes 238*a* decreases gradually as the position goes down in the opposed direction D2 (from the level of the top ends 238*d* of the facing electrodes 238*a* to the level of their bottom ends 238*e*), the space saving effect is great and the miniaturization is made even easier.

As shown in FIG. 19, the angles θ1 and θ2 that are formed by the plane D1 connecting the discharge wire 237 and the rotation center J of the photoreceptor 229 and the inner surfaces 238*c* of the facing electrodes 238*a* are set identical, the positional relationships between the discharge wire 237 and the inner surfaces 238*c* of the facing electrodes 238*a* are the same. Therefore, discharge is not concentrated on one counter electrode 238*a* and hence stable discharge can be realized.

As described above, the facing electrodes 238*a* are arranged so that discharge tends to be concentrated on their bottom end 38*e* side (i.e., on the photoreceptor 229 side) and the opening 323 through which to introduce air from the outside is provided between the top ends 238*d*, in the opposed direction D2, of the facing electrodes 238*a* (see FIG. 19). Because of the concentration of discharge, an air flow occurs toward the bottom end side (i.e., toward the discharge concentration side). Air that has been guided from the opening 323 flows to the photoreceptor 229 smoothly, which effectively prevents pollution of the discharge wire 237.

Further, as shown in FIG. 21, the air passages 362 for guiding, along a path that is different from the flow passage extending between the opening 323 and the photoreceptor 229, air that has flown from the opening 323 to the photoreceptor 229 is provided outside the facing electrodes 238*a*. This makes it possible to smoothly eject air around the photoreceptor 229 without obstructing an air flow that is directed from the opening 323 to the photoreceptor 229.

Still further, since as shown in FIG. 19 the grid electrode 228*b* is provided between the bottom ends 238*e*, in the opposed direction D2, of the facing electrodes 238*a*, ions to be supplied to the photoreceptor 229 can be controlled properly.

Other Embodiments

The configuration of the laser printer 201 is not limited to the second embodiment described above with reference to the drawings. For example, the following configurations are also included in the technical scope of the invention and, in addition, various modifications are possible without departing from the spirit and scope of the invention.

(1) Although the above embodiment employs the scorotron charger 230 as an exemplary charger, the invention may be implemented by using a scorotron charger not having a grid electrode.

(2) In the above embodiment, the charger 230 is provided in the process cartridge 220. However, the charger may be provided in the main body of an image forming apparatus, the main body being part, other than the process cartridge, of the image forming apparatus.

(3) Although the above embodiment employs the wire as an exemplary discharge electrode, the discharge electrode may be a metal plate that is integrally formed with plural sharp edge portions. For example, a structure is possible that a metal plate is formed with plural sharp edge portions that are arranged in a direction parallel with the axial direction of the photoreceptor 229 and that are opposed to facing electrodes like the ones used in the above embodiment. In this case, the sharp edge portions correspond to the discharge portions of discharge electrodes. Further, in this case, a line connecting the edges of the plural sharp edge portions formed on the metal plate may be set parallel with the longitudinal directions of the facing electrodes and the axial direction of the photoreceptor 229.

(4) Although in the above embodiment an air flow is generated by the fan 370, an air flow may be generated only by the scorotron charger 230 (the fan 370 is not used). That is, an air flow may be generated by a spontaneous flow of ions generated by corona discharge (ion wind).

(5) In the above embodiment, as shown in FIG. 19, the interval decreasing region C2 extends in the opposed direction D2 between the position corresponding to the top ends 238*d* of the facing electrodes 238*a* and the position corresponding to their bottom ends 238*e*. However, The top end of the interval decreasing region may be lower than the position corresponding to the top ends 238*d* of the facing electrodes 238*a* as long as it is located over the discharge portion of the discharge electrode (i.e., located in a region C3). For example, referring to FIG. 19, the interval decreasing region may extend in the opposed direction D2 between a prescribed position in the region C3 and the position corresponding to the bottom ends 238*e* of the facing electrodes 238*a*.

In the above description, there are described in detail of two independent embodiments of the first and the second embodiments to which the present invention is applied. However, one skilled in the art may arbitrary combine the subject matters included in the two embodiments to thereby provide an image forming apparatus having the advantages described above with respect to the two embodiments.

The foregoing description of the embodiments has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application program to enable one skilled in the art to utilize the invention in various embodiments and with various modifications as are suited to the particular use contemplated. It is intended that the scope of the invention be defined by the claims appended hereto, and their equivalents.

What is claimed is:

1. A charger that is opposed to a charging subject member and charges the charging subject member by generating corona discharge, the charger comprising:

a discharge electrode;

a pair of facing electrodes that are disposed to face each other with the discharge electrode interposed therebetween and arranged to be apart from the discharge electrode, wherein the facing electrodes are arranged that an interval between the facing electrodes gradually decreases towards the charging subject member, and an opening provided between top ends of the facing electrodes, wherein the opening spans the distance between the pair of facing electrodes.

2. The charger according to claim 1, wherein the charging subject member is a rotary photoreceptor, wherein the facing electrodes are disposed to face each other with the discharge electrode interposed therebetween and are disposed on both sides of the discharge electrode with respect to a rotation direction of the photoreceptor, and wherein when defined that a side to the photoreceptor with respect to the discharge electrode is a downward portion and that a side opposite to the downward portion is an upward portion in a facing direction that the discharge electrode and the photoreceptor faces, the facing electrodes are arranged that the interval between the facing electrodes gradually decreases from the upward portion to the downward portion.

3. The charger according to claim 2, wherein the facing electrodes have inner surfaces that face the discharge electrode, the inner surfaces being flat surfaces in an entire interval decreasing region where the interval between the facing electrodes gradually decreases.

4. The charger according to claim 2, wherein the facing electrodes are arranged that the interval between the facing electrodes gradually decreases from top ends of the facing electrodes to bottom ends of the facing electrodes.

5. The charger according to claim 2, wherein the facing electrodes are arranged that angles formed by a plane connecting the discharge electrode and a rotation center of the photoreceptor and the inner surfaces of the facing electrodes are identical.

6. The charger according to claim 1, wherein the opening introduces air from outside the facing electrodes.

7. The charger according to claim 6 further comprising an air passage at a position outside of the facing electrodes, the air passage guiding, along a path that is different from a flow passage extending between the opening and the photoreceptor, air from the opening to the photoreceptor.

8. The charger according to claim 2 further comprising a grid electrode that is provided between bottom ends of the facing electrodes.

9. The charger according to claim 1, wherein the discharge electrode is a wire.

10. An image forming apparatus comprising:

a photoreceptor;

a charger that is opposed to the photoreceptor and charges the photoreceptor by generating corona discharge; and a fixing member that fixes, on a recording subject medium, a developer image that is formed on the photoreceptor and transferred to the recording subject medium, wherein the charger includes:

a discharge electrode; and a pair of facing electrodes that are disposed to face with each other being the discharge electrode interposed therebetween and arranged to be distant from the discharge electrode, wherein the facing electrodes are arranged that an interval between the facing electrodes gradually decreases towards the charging subject member, an opening provided between top ends of the facing electrodes, wherein the opening spans the distance between the pair of facing electrodes.

11. The image forming apparatus according to claim 10 farther comprising:

an apparatus main body; and a process cartridge that is configured to be detachable from the apparatus main body, the process cartridge being provided with the photoreceptor and the charger.

12. The image forming apparatus according to claim 10 further comprising an inflow suppressing member disposed between the charger and the fixing member and separates a charger-side space and a fixing member-side space from each other, the inflow suppressing member suppressing inflow of air into the charger-side space from the fixing member-side space.

13. The image forming apparatus according to claim 12 further comprising an air flow generating unit that generates an air flow that is directed from the charger-side space towards the photoreceptor.

14. An image forming apparatus comprising:

a photoreceptor;

a charger that is opposed to the photoreceptor and charges the photoreceptor by generating corona discharge with a wire; and a fixing member that fixes, on a recording subject medium, a developer image that is formed on the photoreceptor and transferred to the recording subject medium;

an inflow suppressing member disposed between the charger and the fixing member and separates a charger-side space and a fixing member-side space from each other, the inflow suppressing member suppressing inflow of air into the charger-side space from the fixing member-side space; and an air flow generating unit that generates an air flow that is directed from the charger-side space towards the photoreceptor.

15. The image forming apparatus according to claim 14 further comprising a first frame and a second frame that are disposed on both lateral sides of the image forming apparatus to face each other, at least one of the first and the second frames being provided with an air passage hole, wherein the charger-side space communicates with outside of the image forming apparatus through the air passage hole.

16. The image forming apparatus according to claim 15, wherein the first frame is provided with the air passage hole and an ejection hole for ejecting air to the outside of the image forming apparatus, wherein the image forming apparatus further comprises a duct that is provided with intermediary holes for passage of the air disposed closer to the second frame in which the air passage hole and the ejection hole are not provided, and that guides air that enters through the air passage hole and passed through the intermediary holes to the ejection hole along a path different from the charger-side space.

17. The image forming apparatus according to claim 16 further comprising an ozone filter that is disposed in the duct between the intermediary holes and the ejection hole.

18. The image forming apparatus according to claim 16 further comprising a driving mechanism that drives the photoreceptor, the driving mechanism being provided on the second frame.

19. The image forming apparatus according to claim 16 further comprising a supply mechanism that supplies electric power to the wire, the supply mechanism being provided on the second frame.

20. The image forming apparatus according to claim 14 further comprising:

an exposing unit that exposes the photoreceptor at an exposure position; and an air passage that guides an air flow that flows from the charger towards the photoreceptor in a direction that departs from the photoreceptor, the air passage being provided between a charging position where the charger is opposed to the photoreceptor and the exposure position of the exposing unit on an outer circumferential surface of the photoreceptor.

21. The image forming apparatus according to claim 14, wherein the charger is a scorotron charger that is provided with the wire and a grid electrode, and wherein the air flow generating unit is formed by the scorotron charger.

22. The image forming apparatus according to claim 14 further comprising:

an apparatus main body; and a process cartridge that is configured to be detachable from the apparatus main body, the process cartridge being provided with the photoreceptor and the charger.

23. The image forming apparatus according to claim 22, wherein the charger-side space is formed by a cartridge accommodation portion that accommodates the process in the apparatus main body, wherein the fixing member-side space is formed by a fixing member accommodation portion that accommodates the fixing member and communicates with the cartridge accommodation portion through an opening, wherein the image forming apparatus further comprises a closing rib that increases a closed area of the opening, the closing rib being provided on an outer surface of the process cartridge at a portion closer to the fixing member than the charger, and wherein the inflow suppressing member is configured to close the opening by the outer surface of the process cartridge.

24. The image forming apparatus according to claim 23, wherein the closing rib is formed parallel with a longitudinal direction of the wire and covers, and along at least an entire region where the wire is stretched.

25. The image forming apparatus according to claim 23, wherein the closing rib is formed parallel with a longitudinal direction of the wire and covers, and along at least an entire printing region of the photoreceptor.

26. The image forming apparatus according to claim 23 further comprising a wiper having a manipulation portion and a cleaning member that is moved together with the manipulation portion, the wiper cleaning the wire by sliding the cleaning member in a stretched direction of the wire as the manipulation portion is manipulated, wherein the closing rib is provided so as not to cover the manipulation portion.

27. The image forming apparatus according to claim 23, wherein a rear end portion of the process cartridge is formed as a tapered portion in which thickness thereof decreases towards the fixing member, and wherein the closing rib projects in a thickness direction of the process cartridge so as to fit in a region that is the same in thickness as a proximal portion of the tapered portion in the thickness direction.

28. The image forming apparatus according to claim 23 further comprising an opening rib that projects in a direction opposite to a projection direction of the closing rib so as to form part of the opening that connects the cartridge accommodation portion and the fixing member accommodation portion, the opening rib being provided in such a manner that its disposition region overlaps with a disposition region of the closing rib in the projection direction of the closing rib.

29. The image forming apparatus according to claim 14 further comprising re-entry preventing member that prevents an air flow that flows from the charger towards the photoreceptor from flowing back into the charger-side space.

30. A process cartridge that is configured to be detachable from an apparatus main body of an image forming apparatus having a fixing member that fixes a developer image transferred to a recording subject medium, the process cartridge comprising:

a photoreceptor on which the developer image is formed;

a charger that is opposed to the photoreceptor and charges the photoreceptor by generating corona discharge; and an inflow suppressing member disposed between the charger and the fixing member and separates a charger-side space and a fixing member-side space from each other, the inflow suppressing member suppressing inflow of air into the charger-side space from the fixing member-side space, wherein an air flow that is directed from the charger-side space towards the photoreceptor is generated.

31. The process cartridge according to claim 30 further comprising an air passage that guides an air flow that flows from the charger towards the photoreceptor in a direction that departs from the photoreceptor, the air passage being provided between a charging position where the charger is opposed to the photoreceptor and an exposure position of the photoreceptor.

32. The process cartridge according to claim 30, wherein the charger is a scorotron charger that is provided with the wire and a grid electrode, and wherein the scorotron charger generates the air flow that is directed from the charger-side space towards the photoreceptor.

33. The process cartridge according to claim 30, wherein the process cartridge is accommodated in a cartridge accommodation portion that communicates with, via an opening, a fixing member accommodation portion that forms the fixing member-side space in the apparatus main body, wherein the charger-side space is formed by the cartridge accommodation portion, wherein the process cartridge further comprises a closing rib that increases a closed area of the opening, the closing rib being provided on an outer surface of the process cartridge at a portion closer to the fixing member than the charger, and wherein the inflow suppressing member is configured to close the opening by the outer surface of the process cartridge.

34. The process cartridge according to claim 33, wherein the closing rib is formed parallel with a longitudinal direction of the wire and covers, in the longitudinal direction, at least an entire region where the wire is stretched.

35. The process cartridge according to claim 33, wherein the closing rib is formed parallel with a longitudinal direction of the wire and covers, in the longitudinal direction, at least an entire printing region of the photoreceptor.

36. The process cartridge according to claim 33 further comprising a wiper having a manipulation portion and a cleaning member that is moved together with the manipulation portion, the wiper cleaning the wire by sliding the cleaning member in a stretched direction of the wire as the manipulation portion is manipulated, wherein the closing rib is provided so as not to cover the manipulation portion.

37. The process cartridge according to claim 33, wherein a rear end portion of the process cartridge is formed as a tapered portion in which thickness thereof decreases towards the fixing member, and wherein the closing rib projects in a thickness direction of the process cartridge so as to fit in a region that is the same in thickness as a proximal portion of the tapered portion in the thickness direction.

* * * * *